US008950514B2

(12) United States Patent
Buske et al.

(10) Patent No.: US 8,950,514 B2
(45) Date of Patent: Feb. 10, 2015

(54) DRILL BITS WITH ANTI-TRACKING FEATURES

(75) Inventors: Robert J. Buske, The Woodlands, TX (US); John F. Bradford, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 797 days.

(21) Appl. No.: 13/172,507

(22) Filed: Jun. 29, 2011

(65) Prior Publication Data

US 2011/0315452 A1 Dec. 29, 2011

Related U.S. Application Data

(60) Provisional application No. 61/359,606, filed on Jun. 29, 2010.

(51) Int. Cl.
*E21B 10/14* (2006.01)
*E21B 10/16* (2006.01)

(52) U.S. Cl.
CPC ..... *E21B 10/14* (2013.01); *E21B 10/16* (2013.01)
USPC ..... 175/336; 175/331

(58) Field of Classification Search
CPC ..... E21B 10/06; E21B 10/14
USPC ..... 175/331, 336
See application file for complete search history.

(56) References Cited

U.S. PATENT DOCUMENTS

| | | | |
|---|---|---|---|
| 930,759 | A | 8/1909 | Hughes |
| 1,388,424 | A | 9/1921 | George |
| 1,394,769 | A | 10/1921 | Sorensen |
| 1,519,641 | A | 12/1924 | Thompson |
| 1,729,062 | A | 9/1929 | Bull |
| 1,801,720 | A | 4/1931 | Bull |
| 1,816,568 | A | 7/1931 | Carlson |
| 1,821,474 | A | 9/1931 | Mercer |
| 1,874,066 | A | 8/1932 | Scott et al. |
| 1,879,127 | A | 9/1932 | Schlumpf |
| 1,896,243 | A | 2/1933 | Macdonald |

(Continued)

FOREIGN PATENT DOCUMENTS

| | | |
|---|---|---|
| DE | 1301784 | 8/1969 |
| EP | 0225101 | 6/1987 |

(Continued)

OTHER PUBLICATIONS

Georgescu, M., International Search Report for International Patent Application No. PCT/US2011/042437, dated Nov. 9, 2011, European Patent Office.

(Continued)

*Primary Examiner* — Giovanna Wright
(74) *Attorney, Agent, or Firm* — Sutton McAughan Deaver, PLLC

(57) ABSTRACT

Drill bits with at least two roller cones of different diameters and/or utilizing different cutter pitches in order to reduce bit tracking during drilling operations are described. In particular, earth boring drill bits are provided, the bits having two or more roller cones, and optionally one or more cutter blades, the bits being arranged for reducing tracking by the roller cone teeth during operation by adjusting the teeth spacing, cone pitch angle, and/or the diameter of one or more of the cones. These configurations enable anti-tracking behavior and enhanced drilling efficiency during bit operation.

34 Claims, 19 Drawing Sheets

(56) References Cited

U.S. PATENT DOCUMENTS 1,932,487 A 10/1933 Scott
2,030,722 A 2/1936 Scott
2,117,481 A 5/1938 Howard et al.
2,119,618 A 6/1938 Zublin
2,184,067 A 12/1939 Zublin
2,198,849 A 4/1940 Waxler
2,216,894 A 10/1940 Stancliff
2,244,537 A 6/1941 Kammerer
2,297,157 A 9/1942 Mcclinton
2,318,370 A 5/1943 Burch
2,320,136 A 5/1943 Kammerer
2,320,137 A 5/1943 Kammerer
2,380,112 A 7/1945 Kinnear
2,533,259 A 6/1946 Woods et al.
2,533,258 A 12/1950 Morlan et al.
RE23,416 E 10/1951 Kinnear
2,575,438 A 11/1951 Alexander et al.
2,628,821 A 2/1953 Alexander et al.
2,719,026 A 9/1955 Boice
2,815,932 A 12/1957 Wolfram
2,994,389 A 8/1961 Bus, Sr.
3,010,708 A 11/1961 Hlinsky et al.
3,039,503 A 6/1962 Mainone
3,050,293 A 8/1962 Hlinsky
3,055,443 A 9/1962 Edwards
3,066,749 A 12/1962 Hildebrandt
3,126,066 A 3/1964 Williams, Jr.
3,126,067 A 3/1964 Schumacher, Jr.
3,174,564 A 3/1965 Morlan
3,239,431 A 3/1966 Raymond
3,250,337 A 5/1966 Demo
3,269,469 A 8/1966 Kelly, Jr.
3,387,673 A 6/1968 Thompson
3,397,751 A 8/1968 Reichmuth
3,424,258 A 1/1969 Nakayama
3,583,501 A 6/1971 Aalund
RE28,625 E 11/1975 Cunningham
4,006,788 A 2/1977 Garner
4,108,259 A 8/1978 Dixon et al.
4,140,189 A 2/1979 Garner
4,190,126 A 2/1980 Kabashima
4,190,301 A 2/1980 Lachonius et al.
4,260,203 A 4/1981 Garner
4,270,812 A 6/1981 Thomas
4,285,409 A 8/1981 Allen
4,293,048 A 10/1981 Kloesel, Jr.
4,320,808 A 3/1982 Garrett
4,343,371 A 8/1982 Baker, III et al.
4,359,112 A 11/1982 Garner et al.
4,359,114 A 11/1982 Miller et al.
4,369,849 A 1/1983 Parrish
4,386,669 A 6/1983 Evans
4,408,671 A 10/1983 Munson
4,410,284 A 10/1983 Herrick
4,428,687 A 1/1984 Zahradnik
4,444,281 A 4/1984 Schumacher, Jr. et al.
4,456,082 A 6/1984 Harrison
4,468,138 A 8/1984 Nagel
4,527,637 A 7/1985 Bodine
4,572,306 A 2/1986 Dorosz
4,600,064 A 7/1986 Scales et al.
4,627,882 A 12/1986 Soderstrom
4,641,718 A 2/1987 Bengtsson
4,657,091 A 4/1987 Higdon
4,664,705 A 5/1987 Horton et al.
4,690,228 A 9/1987 Voelz et al.
4,706,765 A 11/1987 Lee et al.
4,726,718 A 2/1988 Meskin et al.
4,727,942 A 3/1988 Galle et al.
4,729,440 A 3/1988 Hall
4,738,322 A 4/1988 Hall et al.
4,756,631 A 7/1988 Jones
4,763,736 A * 8/1988 Varel, Sr. ..... 175/341
4,765,205 A 8/1988 Higdon
4,802,539 A 2/1989 Hall et al.
4,819,703 A 4/1989 Rice et al.
4,825,964 A 5/1989 Rives
4,865,137 A 9/1989 Bailey et al.
4,874,047 A 10/1989 Hixon
4,875,532 A 10/1989 Langford, Jr.
4,880,068 A 11/1989 Bronson
4,892,159 A 1/1990 Holster
4,892,420 A 1/1990 Kruger
4,915,181 A 4/1990 Labrosse
4,932,484 A 6/1990 Warren et al.
4,936,398 A 6/1990 Auty et al.
4,943,488 A 7/1990 Sung et al.
4,953,641 A 9/1990 Pessier
4,976,324 A 12/1990 Tibbitts
4,981,184 A 1/1991 Knowlton et al.
4,984,643 A 1/1991 Isbell et al.
4,991,671 A 2/1991 Pearce et al.
5,016,718 A 5/1991 Tandberg
5,027,912 A 7/1991 Juergens
5,027,914 A 7/1991 Wilson
5,028,177 A 7/1991 Meskin et al.
5,030,276 A 7/1991 Sung et al.
5,037,212 A 8/1991 Justman et al.
5,049,164 A 9/1991 Horton et al.
5,092,687 A 3/1992 Hall
5,116,568 A 5/1992 Sung et al.
5,137,097 A 8/1992 Fernandez
5,145,017 A 9/1992 Holster et al.
5,176,212 A 1/1993 Tandberg
5,199,516 A 4/1993 Fernandez
5,224,560 A 7/1993 Fernandez
5,238,074 A 8/1993 Tibbitts et al.
5,253,939 A 10/1993 Hall
5,287,936 A 2/1994 Grimes et al.
5,289,889 A 3/1994 Gearhart et al.
5,337,843 A 8/1994 Torgrimsen et al.
5,342,129 A 8/1994 Dennis et al.
5,346,026 A 9/1994 Pessier et al.
5,351,770 A 10/1994 Cawthorne et al.
5,361,859 A 11/1994 Tibbitts
5,429,200 A 7/1995 Blackman et al.
5,439,067 A 8/1995 Huffstutler
5,439,068 A 8/1995 Huffstutler et al.
5,452,771 A 9/1995 Blackman et al.
5,467,836 A 11/1995 Grimes et al.
5,472,057 A 12/1995 Winfree
5,472,271 A 12/1995 Bowers et al.
5,494,123 A 2/1996 Nguyen
5,513,715 A 5/1996 Dysart
5,518,077 A 5/1996 Blackman et al.
5,531,281 A 7/1996 Murdock
5,547,033 A 8/1996 Campos, Jr.
5,553,681 A 9/1996 Huffstutler et al.
5,558,170 A 9/1996 Thigpen et al.
5,560,440 A 10/1996 Tibbitts
5,570,750 A 11/1996 Williams
5,593,231 A 1/1997 Ippolito
5,595,255 A 1/1997 Huffstutler
5,606,895 A 3/1997 Huffstutler
5,624,002 A 4/1997 Huffstutler
5,641,029 A 6/1997 Beaton et al.
5,644,956 A 7/1997 Blackman et al.
5,655,612 A 8/1997 Grimes et al.
D384,084 S 9/1997 Huffstutler et al.
5,695,018 A 12/1997 Pessier et al.
5,695,019 A 12/1997 Shamburger, Jr.
5,755,297 A 5/1998 Young et al.
5,839,526 A 11/1998 Cisneros et al.
5,862,871 A 1/1999 Curlett
5,868,502 A 2/1999 Cariveau et al.
5,873,422 A 2/1999 Hansen et al.
5,941,322 A 8/1999 Stephenson et al.
5,944,125 A 8/1999 Byrd
5,967,246 A 10/1999 Caraway et al.
5,979,576 A 11/1999 Hansen et al.
5,988,303 A 11/1999 Arfele
5,992,542 A 11/1999 Rives
5,996,713 A 12/1999 Pessier et al.
6,045,029 A 4/2000 Scott

(56) References Cited

U.S. PATENT DOCUMENTS 6,068,070 A 5/2000 Scott
6,092,613 A 7/2000 Caraway et al.
6,095,265 A 8/2000 Alsup
6,109,375 A 8/2000 Tso
6,116,357 A 9/2000 Wagoner et al.
6,170,582 B1 1/2001 Singh et al.
6,173,797 B1 1/2001 Dykstra et al.
6,190,050 B1 2/2001 Campbell
6,209,185 B1 4/2001 Scott
6,220,374 B1 4/2001 Crawford
6,241,034 B1 6/2001 Steinke et al.
6,241,036 B1 6/2001 Lovato et al.
6,250,407 B1 6/2001 Karlsson
6,260,635 B1 7/2001 Crawford
6,279,671 B1 8/2001 Panigrahi et al.
6,283,233 B1 9/2001 Lamine et al.
6,296,069 B1 10/2001 Lamine et al.
RE37,450 E 11/2001 Deken et al.
6,345,673 B1 2/2002 Siracki
6,360,831 B1 3/2002 Akesson et al.
6,367,568 B2 4/2002 Steinke et al.
6,386,302 B1 5/2002 Beaton
6,401,844 B1 6/2002 Doster et al.
6,405,811 B1 6/2002 Borchardt
6,408,958 B1 6/2002 Isbell et al.
6,415,687 B2 7/2002 Saxman
6,427,791 B1 8/2002 Glowka
6,427,798 B1 8/2002 Imashige
6,439,326 B1 8/2002 Huang et al.
6,446,739 B1 9/2002 Richman et al.
6,450,270 B1 9/2002 Saxton
6,460,635 B1 10/2002 Kalsi et al.
6,474,424 B1 11/2002 Saxman
6,510,906 B1 1/2003 Richert et al.
6,510,909 B2 1/2003 Portwood et al.
6,527,066 B1 3/2003 Rives
6,533,051 B1 3/2003 Singh et al.
6,544,308 B2 4/2003 Griffin et al.
6,561,291 B2 5/2003 Xiang
6,562,462 B2 5/2003 Griffin et al.
6,568,490 B1 5/2003 Tso et al.
6,581,700 B2 6/2003 Curlett et al.
6,585,064 B2 7/2003 Griffin et al.
6,589,640 B2 7/2003 Griffin et al.
6,592,985 B2 7/2003 Griffin et al.
6,601,661 B2 8/2003 Baker et al.
6,601,662 B2 8/2003 Matthias et al.
6,637,528 B2 10/2003 Nishiyama et al.
6,684,966 B2 2/2004 Lin et al.
6,684,967 B2 2/2004 Mensa-Wilmot et al.
6,729,418 B2 5/2004 Slaughter, Jr. et al.
6,739,214 B2 5/2004 Griffin et al.
6,742,607 B2 6/2004 Beaton
6,745,858 B1 6/2004 Estes
6,749,033 B2 6/2004 Griffin et al.
6,797,326 B2 9/2004 Griffin et al.
6,823,951 B2 11/2004 Yong et al.
6,843,333 B2 1/2005 Richert et al.
6,861,098 B2 3/2005 Griffin et al.
6,861,137 B2 3/2005 Griffin et al.
6,878,447 B2 4/2005 Griffin et al.
6,883,623 B2 4/2005 McCormick et al.
6,902,014 B1 6/2005 Estes
6,922,925 B2 8/2005 Watanabe et al.
6,986,395 B2 1/2006 Chen
6,988,569 B2 1/2006 Lockstedt et al.
7,096,978 B2 8/2006 Dykstra et al.
7,111,694 B2 9/2006 Beaton
7,128,173 B2 10/2006 Lin
7,137,460 B2 11/2006 Slaughter, Jr. et al.
7,152,702 B1 12/2006 Bhome et al.
7,197,806 B2 4/2007 Boudreaux et al.
7,198,119 B1 4/2007 Hall et al.
7,234,549 B2 6/2007 McDonough et al.
7,234,550 B2 6/2007 Azar et al.
7,270,196 B2 9/2007 Hall
7,281,592 B2 10/2007 Runia et al.
7,292,967 B2 * 11/2007 McDonough et al. ..... 703/7
7,311,159 B2 12/2007 Lin et al.
7,320,375 B2 1/2008 Singh
7,350,568 B2 4/2008 Mandal et al.
7,350,601 B2 4/2008 Belnap et al.
7,360,612 B2 4/2008 Chen et al.
7,377,341 B2 5/2008 Middlemiss et al.
7,387,177 B2 6/2008 Zahradnik et al.
7,392,862 B2 7/2008 Zahradnik et al.
7,398,837 B2 7/2008 Hall et al.
7,416,036 B2 8/2008 Forstner et al.
7,435,478 B2 10/2008 Keshavan
7,458,430 B2 12/2008 Fyfe
7,462,003 B2 12/2008 Middlemiss
7,473,287 B2 1/2009 Belnap et al.
7,493,973 B2 2/2009 Keshavan et al.
7,517,589 B2 4/2009 Eyre
7,533,740 B2 5/2009 Zhang et al.
7,559,695 B2 7/2009 Sexton et al.
7,568,534 B2 8/2009 Griffin et al.
7,621,346 B1 11/2009 Trinh et al.
7,621,348 B2 11/2009 Hoffmaster et al.
7,647,991 B2 * 1/2010 Felderhoff et al. ..... 175/341
7,703,556 B2 4/2010 Smith et al.
7,703,557 B2 4/2010 Durairajan et al.
7,819,208 B2 10/2010 Pessier et al.
7,836,975 B2 11/2010 Chen et al.
7,845,435 B2 12/2010 Zahradnik et al.
7,845,437 B2 12/2010 Bielawa et al.
7,847,437 B2 12/2010 Chakrabarti et al.
8,177,000 B2 5/2012 Bhome et al.
8,201,646 B2 6/2012 Vezirian
8,302,709 B2 11/2012 Bhome et al.
8,356,398 B2 1/2013 Mccormick et al.
2001/0000885 A1 5/2001 Beuershausen et al.
2001/0030066 A1 10/2001 Clydesdale et al.
2002/0092684 A1 7/2002 Singh et al.
2002/0100618 A1 8/2002 Watson et al.
2002/0108785 A1 8/2002 Slaughter, Jr. et al.
2004/0031625 A1 2/2004 Lin et al.
2004/0099448 A1 5/2004 Fielder et al.
2004/0238224 A1 12/2004 Runia
2005/0087370 A1 4/2005 Ledgerwood et al.
2005/0103533 A1 5/2005 Sherwood, Jr. et al.
2005/0178587 A1 8/2005 Witman, IV et al.
2005/0183892 A1 8/2005 Oldham et al.
2005/0252691 A1 11/2005 Bramlett et al.
2005/0263328 A1 12/2005 Middlemiss
2005/0273301 A1 12/2005 Huang
2006/0027401 A1 2/2006 Nguyen
2006/0032674 A1 2/2006 Chen et al.
2006/0032677 A1 2/2006 Azar et al.
2006/0162969 A1 7/2006 Belnap et al.
2006/0196699 A1 9/2006 Estes et al.
2006/0254830 A1 11/2006 Radtke
2006/0266558 A1 11/2006 Middlemiss et al.
2006/0266559 A1 11/2006 Keshavan et al.
2006/0283640 A1 12/2006 Estes et al.
2007/0029114 A1 2/2007 Middlemiss
2007/0034414 A1 2/2007 Singh et al.
2007/0046119 A1 3/2007 Cooley
2007/0062736 A1 3/2007 Cariveau et al.
2007/0079994 A1 4/2007 Middlemiss
2007/0084640 A1 4/2007 Singh
2007/0131457 A1 6/2007 McDonough et al.
2007/0187155 A1 8/2007 Middlemiss
2007/0221417 A1 9/2007 Hall et al.
2007/0227781 A1 10/2007 Cepeda et al.
2007/0272445 A1 11/2007 Cariveau
2008/0028891 A1 2/2008 Calnan et al.
2008/0029308 A1 2/2008 Chen
2008/0066970 A1 3/2008 Zahradnik et al.
2008/0087471 A1 4/2008 Chen et al.
2008/0093128 A1 4/2008 Zahradnik et al.
2008/0156543 A1 7/2008 McDonough et al.
2008/0164069 A1 7/2008 McDonough et al.
2008/0264695 A1 * 10/2008 Zahradnik et al. ..... 175/336

(56) References Cited

U.S. PATENT DOCUMENTS

| | | | | |
|---|---|---|---|---|
| 2008/0296068 | A1 | 12/2008 | Zahradnik et al. | |
| 2008/0308320 | A1 | 12/2008 | Kolachalam | |
| 2009/0044984 | A1 | 2/2009 | Massey et al. | |
| 2009/0114454 | A1 | 5/2009 | Belnap et al. | |
| 2009/0120693 | A1 | 5/2009 | McClain et al. | |
| 2009/0126998 | A1 | 5/2009 | Zahradnik et al. | |
| 2009/0159338 | A1 | 6/2009 | Buske | |
| 2009/0159341 | A1 | 6/2009 | Pessier et al. | |
| 2009/0166093 | A1 | 7/2009 | Pessier et al. | |
| 2009/0178855 | A1 | 7/2009 | Zhang et al. | |
| 2009/0178856 | A1 | 7/2009 | Singh et al. | |
| 2009/0183925 | A1 | 7/2009 | Zhang et al. | |
| 2009/0236147 | A1 | 9/2009 | Koltermann et al. | |
| 2009/0272582 | A1 | 11/2009 | Mccormick et al. | |
| 2009/0283332 | A1 | 11/2009 | Dick et al. | |
| 2010/0018777 | A1 | 1/2010 | Pessier et al. | |
| 2010/0043412 | A1 | 2/2010 | Dickinson et al. | |
| 2010/0155146 | A1 | 6/2010 | Nguyen et al. | |
| 2010/0224417 | A1 | 9/2010 | Zahradnik et al. | |
| 2010/0252326 | A1 | 10/2010 | Bhome et al. | |
| 2010/0276205 | A1 | 11/2010 | Oxford et al. | |
| 2010/0288561 | A1 | 11/2010 | Zahradnik et al. | |
| 2010/0320001 | A1 | 12/2010 | Kulkarni | |
| 2011/0024197 | A1 | 2/2011 | Centala et al. | |
| 2011/0079440 | A1 | 4/2011 | Buske et al. | |
| 2011/0079441 | A1 | 4/2011 | Buske et al. | |
| 2011/0079442 | A1 | 4/2011 | Buske et al. | |
| 2011/0079443 | A1 | 4/2011 | Buske et al. | |
| 2011/0162893 | A1* | 7/2011 | Zhang | 175/428 |
| 2012/0111638 | A1 | 5/2012 | Nguyen et al. | |
| 2012/0205160 | A1 | 8/2012 | Ricks et al. | |

FOREIGN PATENT DOCUMENTS

| | | |
|---|---|---|
| EP | 0157278 | 11/1989 |
| EP | 0391683 | 1/1996 |
| EP | 0874128 | 10/1998 |
| GB | 2183694 | 6/1987 |
| GB | 2194571 | 3/1988 |
| GB | 2364340 | 1/2002 |
| GB | 2403313 | 12/2004 |
| JP | 2001159289 | 6/2001 |
| SU | 1331988 | 8/1987 |
| WO | 8502223 | 5/1985 |
| WO | 2008124572 | 10/2008 |

OTHER PUBLICATIONS

Georgescu, M., Written Opinion for International Patent Application No. PCT/US2011/042437, dated Nov. 9, 2011, European Patent Office.

Schneiderbauer, K., the International Search Report for International Patent Application No. PCT/US2012/024134, European Patent Office, dated Mar. 7, 2013.

Schneiderbauer, K., Written Opinion for International Patent Application No. PCT/US2012/024134, European Patent Office, dated Mar. 7, 2013.

Baharlou, International Preliminary Report of Patentability for International Patent Application No. PCT/US2009/050672, The International Bureau of WIPO, dated Jan. 25, 2011.

Becamel, International Preliminary Report on Patentability for the International Patent Application No. PCT/US2010/039100, The International Bureau of WIPO, Switzerland, dated Jan. 5, 2012.

Beijer, International Preliminary Report on Patentability for International Patent Application No. PCT/US2009/042514, The International Bureau of WIPO, dated Nov. 2, 2010.

Buske, et al., "Performance Paradigm Shift: Drilling Vertical and Directional Sections Through Abrasive Formations with Roller Cone Bits", Society of Petroleum Engineers—SPE 114975, CIPC/SPE Gas Technology Symposium 2008 Joint Conference, Canada, Jun. 16-19, 2008.

Choi, International Search Report for International Patent Application No. PCT/US2010/0039100, Korean Intellectual Property Office, dated Jan. 25, 2011.

Choi, Written Opinion for International Patent Application No. PCT/US2010/039100, Korean Intellectual Property Office, dated Jan. 25, 2011.

Wells, et al., "Bit Balling Mitigation in PDC Bit Design", International Association of Drilling Contractors/ Society of Petroleum Engineers—IADC/SPE 114673, IADC/SPE Asia Pacific Drilling Technology Conference and Exhibition, Indonesia, Aug. 25-27, 2008.

Williams, et al., "An Analysis of the Performance of PDC Hybrid Drill Bits", SPE/IADC 16117, SPE/IADC Drilling Conference, pp. 585-594, Mar. 1987.

Ersoy, et al., "Wear characteristics of PDC pin and hybrid core bits in rock drilling", Wear 188, Elsevier Science, S. A., pp. 150-165, Mar. 1995.

George, et al., "Significant Cost Savings Achieved Through the Use of PDC Bits in Compressed Air/Foam Applications", Society of Petroleum Engineers—SPE 116118, 2008 SPE Annual Technical Conference and Exhibition, Denver, Colorado, Sep. 21-24, 2008.

Georgescu, Written Opinion for International Patent Application No. PCT/US2010/051020, European Patent Office, dated Jun. 1, 2011.

Georgescu, International Search Report for International Patent Application No. PCT/US2010/050631, European Patent Office, dated Jun. 10, 2011.

Georgescu, Written Opinion for International Patent Application No. PCT/US2010/050631, European Patent Office, dated Jun. 10, 2011.

Georgescu, International Search Report for International Patent Application No. PCT/US2010/051020, European Patent Office, dated Jun. 1, 2011.

Georgescu, International Search Report for International Patent Application No. PCT/US2010/051019, European Patent Office, dated Jun. 6, 2011.

Georgescu, Written Opinion for International Patent Application No. PCT/US2010/051019, European Patent Office, dated Jun. 6, 2011.

Georgescu, International Search Report for International Patent Application No. PCT/US2010/051017, European Patent Office, dated Jun. 8, 2011.

Georgescu, Written Opinion for International Patent Application No. PCT/US2010/051017, European Patent Office, dated Jun. 8, 2011.

Georgescu, International Search Report for International Patent Application No. PCT/US2010/051014, European Patent Office, dated Jun. 9, 2011.

Georgescu, Written Opinion for International Patent Application No. PCT/US2010/051014, European Patent Office, dated Jun. 9, 2011.

Georgescu, International Search Report for International Patent Application No. PCT/US2011/042437, European Patent Office, dated Nov. 9, 2011.

Georgescu, Written Opinion for International Patent Application No. PCT/US2011/042437, European Patent Office, dated Nov. 9, 2011.

Kang, International Search Report for International Patent Application No. PCT/US2010/033513, Korean Intellectual Property Office, dated Jan. 10, 2011.

Kang, Written Opinion for International Patent Application No. PCT/US2010/033513, Korean Intellectual Property Office, dated Jan. 10, 2011.

Kang, International Search Report for International Patent Application No. PCT/US2010/032511, Korean Intellectual Property Office, dated Jan. 17, 2011.

Kang, Written Opinion for International Patent Application No. PCT/US2010/032511, Korean Intellectual Property Office, dated Jan. 17, 2011.

Kim, International Search Report for International Patent Application No. PCT/US2009/067969, Korean Intellectual Property Office, dated May 25, 2010.

Kim, Written Opinion for International Patent Application No. PCT/US2009/067969, Korean Intellectual Property Office, dated May 25, 2010.

Lee, International Search Report for International Patent Application No. PCT/US2009/042514, Korean Intellectual Property Office, Nov. 27, 2009.

Lee, Written Opinion for International Patent Application No. PCT/US2009/042514, Korean Intellectual Property Office, dated Nov. 27, 2009.

(56) References Cited

OTHER PUBLICATIONS

Warren, et al., "PDC Bits: What's Needed to Meet Tomorrow's Challenge", SPE 27978, University of Tulsa Centennial Petroleum Engineering Symposium, pp. 207-214, Aug. 1994.
Lee, International Search Report for International Patent Application No. PCT/US2009/050672, Korean Intellectual Property Office, dated Mar. 3, 2010.
Lee, Written Opinion for International Patent Application No. PCT/US2009/050672, Korean Intellectual Property Office, dated Mar. 3, 2010.
Smith Services, "Hole Opener—Model 6980 Hole Opener", retrieved from the internet on May 7, 2008 using <URL: http://www.siismithservices.com/b_products/product_page.asp?ID=589>.
Tomlinson, et al., "Rock Drilling—Syndax3 Pins—New Concepts in PCD Drilling", Industrial Diamond Review, pp. 109-114, Mar. 1992.
Mills Machine Company, "Rotary Hole Openers—Section 8", retrieved from the internet on May 7, 2009 using <URL: http://www.millsmachine.com/pages/home_page/mills_catalog/cat_holeopen/cat_holeopen.pdf>.
Ott, International Search Report for International Patent Application No. PCT/US2010/049159, European Patent Office, dated Apr. 21, 2011.
Ott, Written Opinion for International Patent Application No. PCT/US2010/049159, European Patent Office, dated Apr. 21, 2011.
Pessier, et al., "Hybrid Bits Offer Distinct Advantages in Selected Roller Cone and PDC Bit Applications", IADC/SPE Paper No. 128741, Feb. 2010, pp. 1-9.
Sheppard, et al., "Rock Drilling—Hybrid Bit Success for Syndax3 Pins", Industrial Diamond Review, pp. 309-311, Jun. 1993.
Schouten, International Search Report for International Patent Application No. PCT/US2008/083532, European Patent Office, Feb. 25, 2009.
Schouten, Written Opinion for International Patent Application No. PCT/US2008/083532, European Patent Office, Feb. 25, 2009.

* cited by examiner 102a
102a
100a
102a
102b
100b
102b
102b 102a
102a
100a
102a
102b
100b
102b
102b 102a
102a
100a
102a
102b
100b
102b
102b 102a
102a
100a
102a
102b
100b
102b
102b

| IADC BIT CLASSIFICATION SYSTEM<br>BIT FORMATION SERIES & TYPES | | |
|---|---|---|
| MILLED TOOTH BITS | | |
| Series | Formation | Types |
| 1 | Soft Formations/Low-Compressive Strength | 1<br>2<br>3 |
| 2 | Medium to Medium-Hard Formations/Compressive Strength | 1<br>2<br>3 |
| 3 | Hard, Semi-Abrasive Formations | 1<br>2<br>3 |
| TCI BITS | | |
| Series | Formation | Types |
| 4 | Soft Formations/Low-Compressive Strength | 1<br>2<br>3<br>4 |
| 5 | Soft to Medium-Hard Formations/Low-Compressive Strength | 1<br>2<br>3<br>4 |
| 6 | Medium-Hard Formations/High-Compressive Strength | 1<br>2<br>3<br>4 |
| 7 | Hard, Semi-Abrasive and Abrasive Formations | 1<br>2<br>3<br>4 |
| 8 | Extremely Hard and Abrasive Formations | 1<br>2<br>3<br>4 |

FIG. 19

DRILL BITS WITH ANTI-TRACKING FEATURES

CROSS REFERENCE TO RELATED APPLICATIONS

The present application claims priority to U.S. Provisional Patent Application Ser. No. 61/359,606, filed Jun. 29, 2010, the contents of which are incorporated herein by reference.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The inventions disclosed and taught herein relate generally to earth-boring drill bits for use in drilling wells, and more specifically, relate to improved earth-boring drill bits, such as those having a combination of two or more roller cones and optionally at least one fixed cutter with associated cutting elements, wherein the bits exhibit reduced tracking during drilling operations, as well as the operation of such bits in downhole environments.

2. Description of the Related Art

Roller cone drill bits are known, as are "hybrid"-type drill bits with both fixed blades and roller cones. Roller cone rock bits are commonly used in the oil and gas industry for drilling wells. A roller cone drill bit typically includes a bit body with a threaded connection at one end for connecting to a drill string and a plurality of roller cones, typically three, attached at the opposite end and able to rotate with respect to the bit body. Disposed on each of the cones are a number of cutting elements, typically arranged in rows about the surface of the individual cones. The cutting elements may typically comprise tungsten carbide inserts, polycrystalline diamond compacts, milled steel teeth, or combinations thereof.

Significant expense is involved in the design and manufacture of drill bits to produce drill bits with increased drilling efficiency and longevity. Roller cone bits can be considered to be more complex in design than fixed cutter bits, in that the cutting surfaces of the bit are disposed on roller cones. Each of the cones on the roller bit rotates independently relative to the rotation of the bit body about an axis oblique to the axis of the bit body. Because the roller cones rotate independent of each other, the rotational speed of each cone is typically different. For any given cone, the cone rotation speed generally can be determined from the rotational speed of the bit and the effective radius of the "drive row" of the cone. The effective radius of a cone is generally related to the radial extent of the cutting elements on the cone that extend axially the farthest, with respect to the bit axis, toward the bottomhole. These cutting elements typically carry higher loads and may be considered as generally located on a so-called "drive row". The cutting elements located on the cone to drill the full diameter of the bit are referred to as the "gage row".

Adding to the complexity of roller cone bit designs, cutting elements disposed on the cones of the roller cone bit deform the earth formation during drilling by a combination of compressive fracturing and shearing forces. Additionally, most modern roller cone bit designs have cutting elements arranged on each cone so that cutting elements on adjacent cones intermesh between the adjacent cones. The intermeshing cutting elements on roller cone drill bits is typically desired in the overall bit design so as to minimize bit balling between adjacent concentric rows of cutting elements on a cone and/or to permit higher insert protrusion to achieve competitive rates of penetration ("ROP") while preserving the longevity of the bit. However, intermeshing cutting elements on roller cone bits substantially constrains cutting element layout on the bit, thereby, further complicating the designing of roller cone drill bits.

One prominent and recurring problem with many current roller cone drill bit designs is that the resulting cone arrangements, whether arrived at arbitrarily or using simulated design parameters, may provide less than optimal drilling performance due to problems which may not be readily detected, such as "tracking" and "slipping." Tracking occurs when cutting elements on a drill bit fall into previous impressions formed by other cutting elements at preceding moments in time during revolution of the drill bit. This overlapping will put lateral pressure on the teeth, tending to cause the cone to align with the previous impressions. Tracking can also happen when teeth of one cone's heel row fall into the impressions made by the teeth of another cone's heel row. Slipping is related to tracking and occurs when cutting elements strike a portion of the previously made impressions and then slide into these previous impressions rather than cutting into the uncut formation, thereby reducing the cutting efficiency of the bit.

In the case of roller cone drill bits, the cones of the bit typically do not exhibit true rolling during drilling due to action on the bottom of the borehole (hereafter referred to as "the bottomhole"), such as slipping. Because cutting elements do not cut effectively when they fall or slide into previous impressions made by other cutting elements, tracking and slipping should preferably be avoided. In particular, tracking is inefficient since there is no fresh rock cut, and thus a waste of energy. Ideally, every hit on a bottomhole will cut fresh rock. Additionally, slipping is undesirable because it can result in uneven wear on the cutting elements which in turn can result in premature bit or cutter failure. It has been found that tracking and slipping often occur due to a less-than-optimum spacing of cutting elements on the bit. In many cases, by making proper adjustments to the arrangement of cutting elements on a bit, problems such as tracking and slipping can be significantly reduced. This is especially true for cutting elements on a drive row of a cone on a roller cone drill bit because the drive row is the row that generally governs the rotation speed of the cones.

As indicated, cutting elements on the cones of the drill bit do not cut effectively when they fall or slide into previous impressions made by other cutting elements. In particular, tracking is inefficient because no fresh rock is cut. It is additionally undesirable because tracking results in slowed rates of penetration (ROP), detrimental wear of the cutting structures, and premature failure of the bits themselves. Slipping is also undesirable because it can result in uneven wear on the cutting elements themselves, which in turn can result in premature cutting element failure. Thus, tracking and slipping during drilling can lead to low penetration rates and in many cases uneven wear on the cutting elements and cone shell. By making proper adjustments to the arrangement of cutting elements on a bit, problems such as tracking and slipping can be significantly reduced. This is especially true for cutting elements on a drive row of a cone because the drive row generally governs the rotation speed of the cone.

Given the importance of these issues, studies related to the quantitative relationship between the overall drill bit design and the degree of gouging-scraping action have been undertaken in attempts to design and select the proper rock bit for drilling in a given formation [See, for example, Dekun Ma and J. J. Azar, SPE Paper No. 19448 (1989)]. A number of proposed solutions exist for varying the orientation of cutting elements on a bit to address these tracking concerns and problems. For example, U.S. Pat. No. 6,401,839 discloses varying the orientation of the crests of chisel-type cutting elements within a row, or between overlapping rows of different cones, to reduce tracking problems and improve drilling performance. U.S. Pat. Nos. 6,527,068 and 6,827,161 both disclose specific methods for designing bits by simulating drilling with a bit to determine its drilling performance and then adjusting the orientation of at least one non-axisymmetric cutting element on the bit and repeating the simulating and determining until a performance parameter is determined to be at an optimum value. The described approaches also require the user to incrementally solve for the motions of individual cones in an effort to potentially overcome tracking during actual bit usage. Such complex simulations require substantial computation time and may not always address other factors that can affect tracking and slippage, such as the hardness of the rock type being drilled.

U.S. Pat. No. 6,942,045 discloses a method of using cutting elements with different geometries on a row of a bit to cut the same track of formation and help reduce tracking problems. However, in many drilling applications, such as the drilling of harder formations, the use of asymmetric cutting elements such as chisel-type cutting elements are not desired due to their poorer performance in these geological applications.

Prior approaches also exist for using different pitch patterns on a given row to address tracking problems. For example, U.S. Pat. Nos. 7,234,549 and 7,292,967 describe methods for evaluating a cutting arrangement for a drill bit that specifically includes selecting a cutting element arrangement for the drill bit and calculating a score for the cutting arrangement. This method may then be used to evaluate the cutting efficiency of various drill bit designs. In one example, this method is used to calculate a score for an arrangement based on a comparison of an expected bottom hole pattern for the arrangement with a preferred bottom hole pattern. The use of this method has reportedly lead to roller cone drill bit designs that exhibit reduced tracking over previous drill bits.

Other approaches have been described which involve new arrangements of cutting elements on an earth-boring drill bit to reduce tracking. For example, U.S. Pat. No. 7,647,991 describes such an arrangement, wherein the heel row of a first cone has at least equal the number of cutting elements as the heel rows of the other cones, the adjacent row of the second cone has at least 90 percent as many cutting elements at the heel row of the first cone, and the heel row of the third cone has a pitch that is in the range from 20-50% greater than the heel rows of the first cone.

While the above approaches are considered useful in particular specific applications, typically directed to address drilling problems in a particular geologic formation, in other applications the use of such varied cutting elements is undesirable, and the use of different pitch patterns can be difficult to implement, resulting in a more complex approach to drill bit design and manufacture than necessary for addressing tracking concerns. What is desired is a simplified design approach that results in reduced tracking for particular applications without sacrificing bit life or requiring increased time or cost associated with design and manufacturing.

One method commonly used to discourage bit tracking is known as a staggered tooth design. In this design the teeth are located at unequal intervals along the circumference of the cone. This is intended to interrupt the recurrent pattern of impressions on the bottom of the hole. However, staggered tooth designs do not prevent tracking of the outermost rows of teeth, where the teeth are encountering impressions in the formation left by teeth on other cones. Staggered tooth designs also have the short-coming that they can cause fluctuations in cone rotational speed and increased bit vibration. For example, U.S. Pat. No. 5,197,555 to Estes discloses rotary cone cutters for rock drill bits using milled-tooth cones and having circumferential rows of wear resistant inserts. As specifically recited therein, "inserts on the two outermost rows are oriented at an angle in relationship to the axis of the cone to either the leading side or trailing side of the cone. Such orientation will achieve either increased resistance to insert breakage and/or increased rate of penetration."

The inventions disclosed and taught herein are directed to an improved drill bit with at least two roller cones designed to reduce tracking of the roller cones while increasing the rate of penetration of the drill bit during operation.

BRIEF SUMMARY OF THE INVENTION

Drill bits having at least two roller cones of different diameters and/or utilizing different cutter pitches are described, wherein such bits exhibit reduced tracking and/or slipping of the cutters on the bit during subterranean drilling operations.

In accordance with a first aspect of the present disclosure, a drill bit is described, the drill bit comprising a bit body having a longitudinal central axis; at least one blade extending from the bit body; a first and second arm extending from the bit body; a first roller cone rotatably secured to the first arm; and a second roller cone rotatably secured to the second arm, wherein the first roller cone is larger in diameter than the second roller cone. In further accordance with this aspect of the disclosure, the drill bit may further include one or more fixed cutting blades extending in an axial downward direction from the bit body, the cutting blades including a plurality of fixed cutting elements mounted to the fixed blades.

In accordance with a further aspect of the present disclosure, a drill bit is described, the drill bit comprising a bit body having a longitudinal central axis; at least one blade extending from the bit body; a first and second arm extending from the bit body; a first roller cone rotatably secured to the first arm and having a plurality of cutting elements arranged in generally circumferential rows thereon; and a second roller cone rotatably secured to the second arm and having a plurality of cutting elements arranged in generally circumferential rows thereon, wherein the first roller cone has a different cutter pitch than the second roller cone. In accordance with further embodiments of this aspect, the first roller cone has a different cone diameter than the second roller cone. In further accordance with this aspect of the disclosure, the drill bit may further include one or more fixed cutting blades extending in an axial downward direction from the bit body, the cutting blades including a plurality of fixed cutting elements mounted to the fixed blades.

In further accordance with aspects of the present disclosure, an earth-boring drill bit is described, the drill bit comprising a bit body; at least two bit legs depending from the bit body and having a circumferentially extending outer surface, a leading side and a trailing side; a first cone and a second cone rotatably mounted on a cantilevered bearing shaft depending inwardly from the bit legs; and, a plurality of cutters arranged circumferentially about the outer surface of the cones, wherein the first cone and the second cone have different cone diameters. In further accordance with this aspect of the disclosure, the cutters associated with one or more of the cones may be of varying pitches, pitch angles, and/or IADC hardnesses as appropriate so as to reduce bit tracking during drilling operations. In further accordance with this aspect of the disclosure, the drill bit may further include one or more fixed cutting blades extending in an axial downward direction from the bit body, the cutting blades including a plurality of fixed cutting elements mounted to the fixed blades.

BRIEF DESCRIPTION OF THE SEVERAL VIEWS OF THE DRAWINGS

The following figures form part of the present specification and are included to further demonstrate certain aspects of the present invention. The invention may be better understood by reference to one or more of these figures in combination with the detailed description of specific embodiments presented herein.

FIG. 19 illustrates a partial view of an exemplary IADC bit classification chart.

Figure 1:
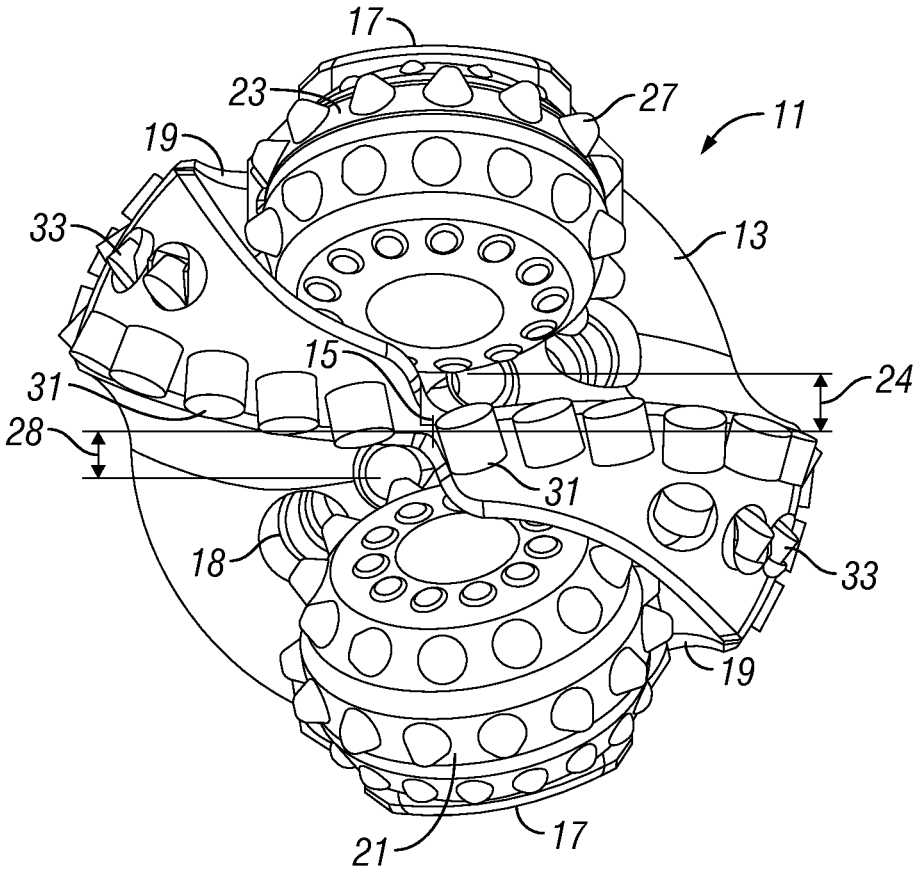
FIG. 1 illustrates a bottom view of an exemplary hybrid drill bit constructed in accordance with certain aspects of the present disclosure.

While the inventions disclosed herein are susceptible to various modifications and alternative forms, only a few specific embodiments have been shown by way of example in the drawings and are described in detail below. The figures and detailed descriptions of these specific embodiments are not intended to limit the breadth or scope of the inventive concepts or the appended claims in any manner. Rather, the figures and detailed written descriptions are provided to illustrate the inventive concepts to a person of ordinary skill in the art and to enable such person to make and use the inventive concepts.

DETAILED DESCRIPTION OF THE INVENTION

The Figures described above and the written description of specific structures and functions below are not presented to limit the scope of what Applicants have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of skill in this art having benefit of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," "first," "second," and the like are used in the written description for clarity in specific reference to the Figures and are not intended to limit the scope of the invention or the appended claims.

Typically, one or more cones on an earth-boring drill bit will rotate at different roll ratios during operation depending on a variety of parameters, including bottom hole pattern, spud-in procedures, changes in formation being drilled, and changes in run parameters. These changes in rotation, as well as other factors such as the arrangement of cutting teeth on the cones, can lead to bit tracking. In order to reduce tracking, a system is required that is not restricted to a single roll ratio during operation. Applicants have created earth-boring drill bits with at least two roller cones of different diameters and/or utilizing different cutter pitches on separate, or adjacent, cones.

Figure 2:
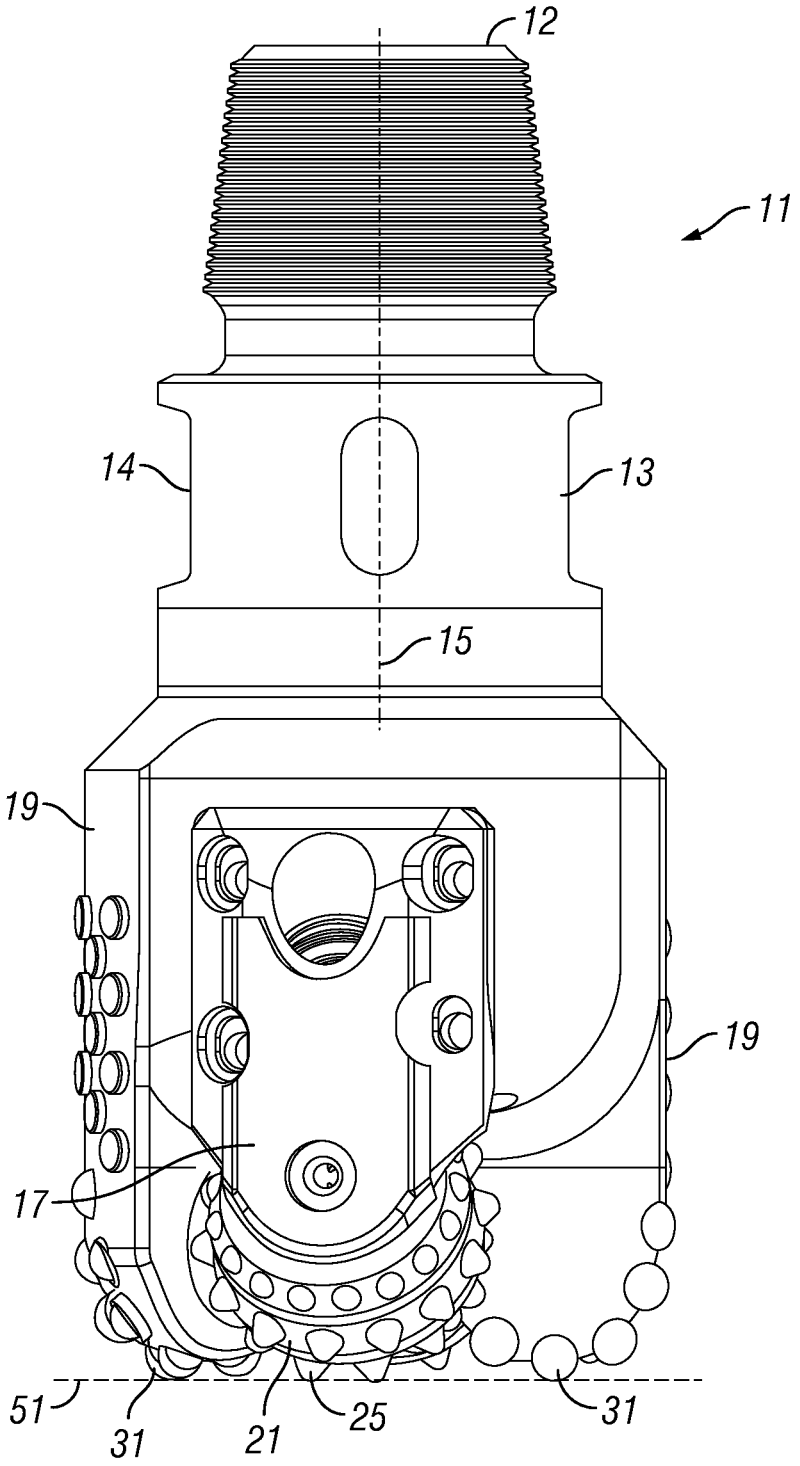
FIG. 2 illustrates a side view of the hybrid drill bit of FIG. 1 constructed in accordance with certain aspects of the present disclosure.
Figure 3:
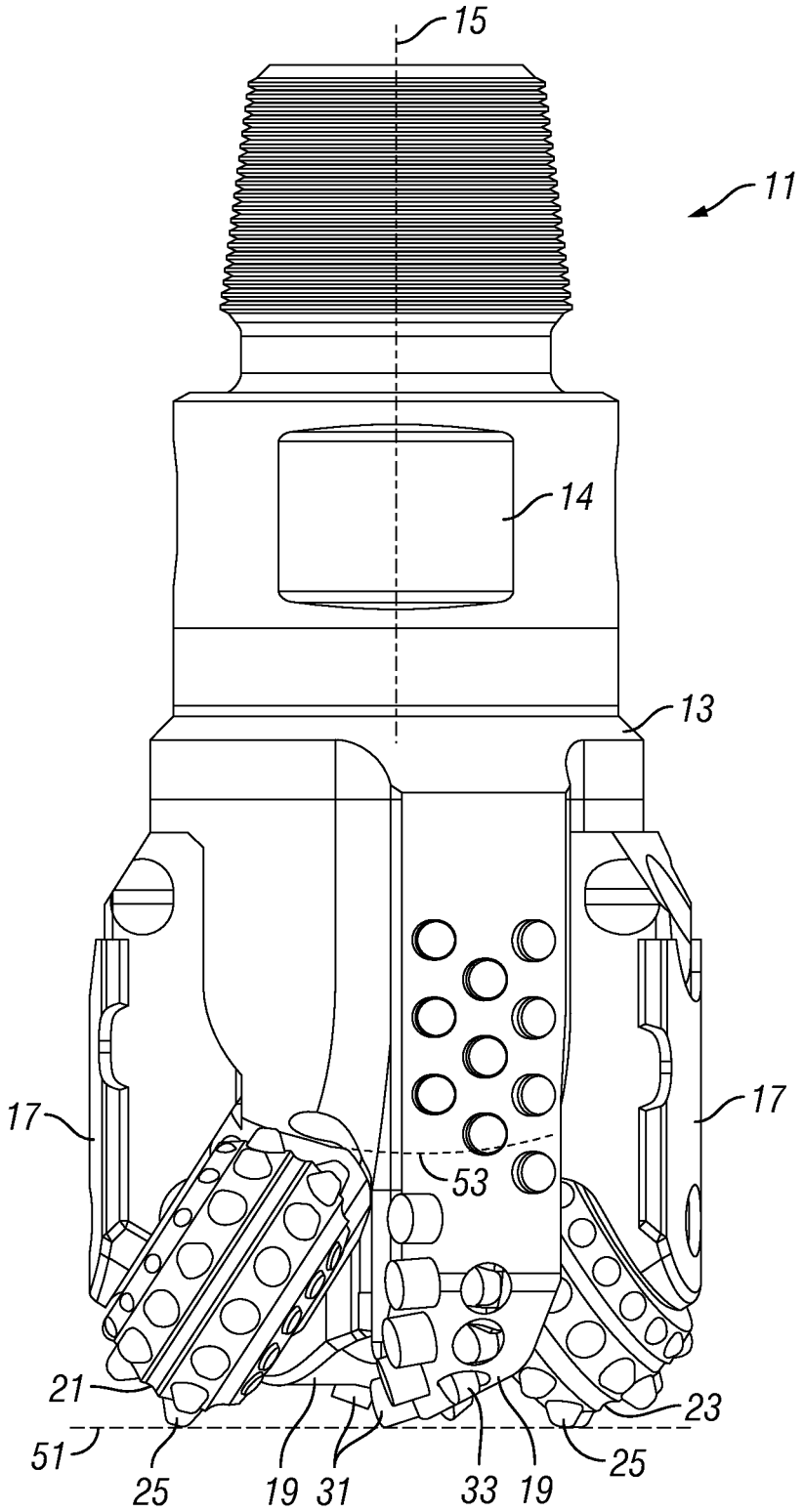
FIG. 3 illustrates a side view of the hybrid drill bit of FIG. 1 constructed in accordance with certain aspects of the present disclosure.
Figure 4:
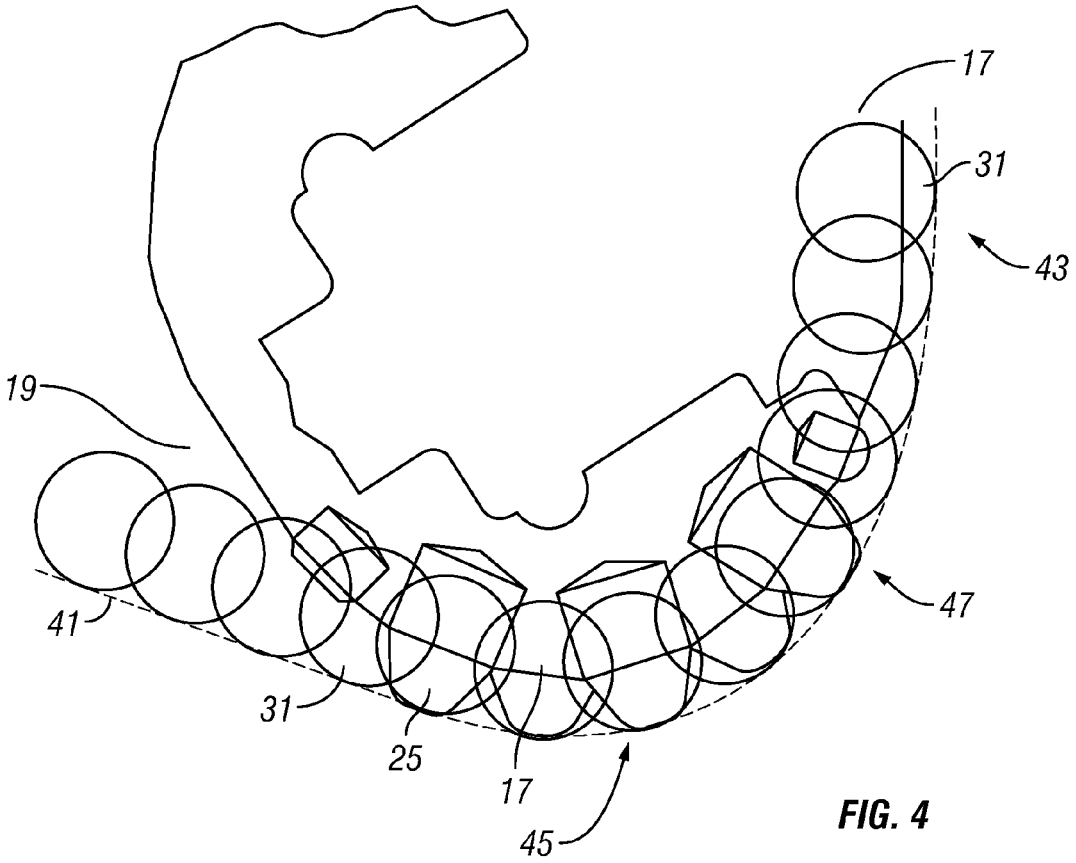
FIG. 4 illustrates composite rotational side view of the roller cone inserts and the fixed cutting elements on the hybrid drill bit of FIG. 1 constructed in accordance with certain aspects of the present disclosure, and interfacing with the formation being drilled.

Referring to FIGS. 1-3, one embodiment of an exemplary earth-boring hybrid drill bit 11 in accordance with the present disclosure is shown. FIG. 1 illustrates an exemplary bottom view of a hybrid drill bit in accordance with the present disclosure. FIG. 2 illustrates an exemplary side view of the drill bit of FIG. 1. FIG. 3 illustrates an exemplary side view of the drill bit shown in FIG. 2, rotated 90°. FIG. 4 illustrates composite rotational side view of the roller cone inserts and the fixed cutting elements on the hybrid drill bit of FIG. 1. These figures will be discussed in conjunction with each other. Select components of the drill bit may be similar to that shown in U.S. Patent Application Publication No. 20080264695, U.S. Patent Application Publication No. 20080296068, and/or U.S. Patent Application Publication No. 20090126998, each of which are incorporated herein by specific reference.

As illustrated in FIGS. 1-3, the earth-boring drill bit 11 comprises a bit body 13 having a central longitudinal axis 15 that defines an axial center of the bit body 13. Hybrid bit 11 includes a bit body 13 that is threaded or otherwise configured at its upper extent 12 for connection into a drill string. The drill bit 11 may comprise one or more roller cone support arms 17 extending from the bit body 13 in the axial direction. The support arms 17 may either be formed as an integral part of the bit body 13 or attached to the exterior of the bit body in pockets (not shown). Each of the support arms may be described as having a leading edge, a trailing edge, an exterior surface disposed therebetween, and a lower shirttail portion that extends downward away from the upper extent 12 of the bit, and toward the working face of the bit. The bit body 13 may also comprise one or more fixed blades 19 that extend in the axial direction. Bit body 13 may be constructed of steel, or of a hard-metal (e.g., tungsten carbide) matrix material with steel inserts. The drill bit body 13 also provides a longitudinal passage within the bit (not shown) to allow fluid communication of drilling fluid through jetting passages and through standard jetting nozzles (not shown) to be discharged or jetted against the well bore and bore face through nozzle ports 18 adjacent the drill bit cutter body 13 during bit operation. In one embodiment of the present disclosure, the centers of the arms 17 and fixed blades 19 are symmetrically spaced apart from each other about the axis 15 in an alternating configuration. In another embodiment, the centers of the arms 17 and fixed blades 19 are asymmetrically spaced apart from each other about the axis 15 in an alternating configuration. For example, the arms 17 may be closer to a respectively leading fixed blade 19, as opposed to the respective following fixed blade 19, with respect to the direction of rotation of the bit 11. Alternatively, the arms 17 may be closer to a respectively following fixed blade 19, as opposed to the respective leading fixed blade 19, with respect to the direction of rotation of the bit 11.

The drill bit body 13 also provides a bit breaker slot 14, a groove formed on opposing lateral sides of the bit shank to provide cooperating surfaces for a bit breaker slot in a manner well known in the industry to permit engagement and disengagement of the drill bit with the drill string (DS) assembly.

Roller cones 21 are mounted to respective ones of the arms 17. Each of the roller cones 21 may be truncated in length such that the distal ends of the roller cones 21 are radially spaced apart from the axial center 15 (FIG. 1) by a minimal radial distance 24. A plurality of roller cone cutting inserts or elements 25 are mounted to the roller cones 21 and radially spaced apart from the axial center 15 by a minimal radial distance 28. The minimal radial distances 24, 28 may vary according to the application, and may vary from cone to cone, and/or cutting element to cutting element.

In addition, a plurality of fixed cutting elements 31 are mounted to the fixed blades 19, 19'. At least one of the fixed cutting elements 31 may be located at the axial center 15 of the bit body 13 and adapted to cut a formation at the axial center. Also, a row or any desired number of rows of back-up cutters 33 may be provided on each fixed blade cutter 19, 19' between the leading and trailing edges thereof. Back-up cutters 33 may be aligned with the main or primary cutting elements 31 on their respective fixed blade cutters 19, 19' so that they cut in the same swath or kerf or groove as the main or primary cutting elements on a fixed blade cutter. Alternatively, they may be radially spaced apart from the main fixed-blade cutting elements so that they cut in the same swath or kerf or groove or between the same swaths or kerfs or grooves formed by the main or primary cutting elements on their respective fixed blade cutters. Additionally, back-up cutters 33 provide additional points of contact or engagement between the bit 11 and the formation being drilled, thus enhancing the stability of hybrid bit 11. Examples of roller cone cutting elements 25, 27 and fixed cutting elements 31, 33 include tungsten carbide inserts, cutters made of super hard material such as polycrystalline diamond, and others known to those skilled in the art.

The term "cone assembly" as used herein includes various types and shapes of roller cone assemblies and cutter cone assemblies rotatably mounted to a support arm. Cone assemblies may also be referred to equivalently as "roller cones" or "cutter cones." Cone assemblies may have a generally conical exterior shape or may have a more rounded exterior shape. Cone assemblies associated with roller cone drill bits generally point inwards towards each other or at least in the direction of the axial center of the drill bit. For some applications, such as roller cone drill bits having only one cone assembly, the cone assembly may have an exterior shape approaching a generally spherical configuration.

The term "cutting element" as used herein includes various types of compacts, inserts, milled teeth and welded compacts suitable for use with roller cone and hybrid type drill bits. The terms "cutting structure" and "cutting structures" may equivalently be used in this application to include various combinations and arrangements of cutting elements formed on or attached to one or more cone assemblies of a roller cone drill bit.

As shown in FIG. 4, the roller cone cutting elements 25, 27 and the fixed cutting elements 31, 33 combine to define a cutting profile 41 that extends from the axial center 15 to a radially outermost perimeter, or gage section, 43 with respect to the axis. In one embodiment, only the fixed cutting elements 31 form the cutting profile 41 at the axial center 15 and the radially outermost perimeter 43. However, the roller cone cutting elements 25 overlap with the fixed cutting elements 31 on the cutting profile 41 between the axial center 15 and the radially outermost perimeter 43. The roller cone cutting elements 25 are configured to cut at the nose 45 and shoulder 47 of the cutting profile 41, where the nose 45 is the leading part of the profile (i.e., located between the axial center 15 and the shoulder 47) facing the borehole wall and located adjacent the gage 43.

Thus, the roller cone cutting elements 25, 27 and the fixed cutting elements 31, 33 combine to define a common cutting face 51 (FIGS. 2 and 3) in the nose 45 and shoulder 47, which are known to be the weakest parts of a fixed cutter bit profile. Cutting face 51 is located at a distal axial end of the hybrid drill bit 11. At least one of each of the roller cone cutting elements 25, 27 and the fixed cutting elements 31, 33 extend in the axial direction at the cutting face 51 at a substantially equal dimension and, in one embodiment, are radially offset from each other even though they axially align. However, the axial alignment between the distal most elements 25, 31 is not required such that elements 25, 31 may be axially spaced apart by a significant distance when in their distal most position. For example, the bit body has a crotch 53 (FIG. 3) defined at least in part on the axial center between the arms 17 and the fixed blades 19, 19'.

In one embodiment, the fixed cutting elements 31, 33 are only required to be axially spaced apart from and distal (e.g., lower than) relative to the crotch 53. In another embodiment, the roller cones 21, 23 and roller cone cutting elements 25, 27 may extend beyond (e.g., by approximately 0.060-inches) the distal most position of the fixed blades 19, 19' and fixed cutting elements 31, 33 to compensate for the difference in wear between those components. As the profile 41 transitions from the shoulder 47 to the perimeter or gage of the hybrid bit 11, the rolling cutter inserts 25 are no longer engaged (see FIG. 4), and multiple rows of vertically-staggered (i.e., axially) fixed cutting elements 31 ream out a smooth borehole wall. Rolling cone cutting elements 25 are much less efficient in reaming and would cause undesirable borehole wall damage.

As the roller cones 21, 23 crush or otherwise work through the formation being drilled, rows of the roller cone cutting elements, or cutters, 25, 27 produce kerfs, or trenches. These kerfs are generally circular, because the bit 11 is rotating during operation. The kerfs are also spaced outwardly about a center line of the well being drilled, just as the rows of the rolling cone cutters 25, 27 are spaced from the central axis 15 of the bit 11. More specifically, each of the cutters 25, 27 typically form one or more craters along the kerf produced by the row of cutters to which that cutter 25, 27 belongs.

Figure 5:
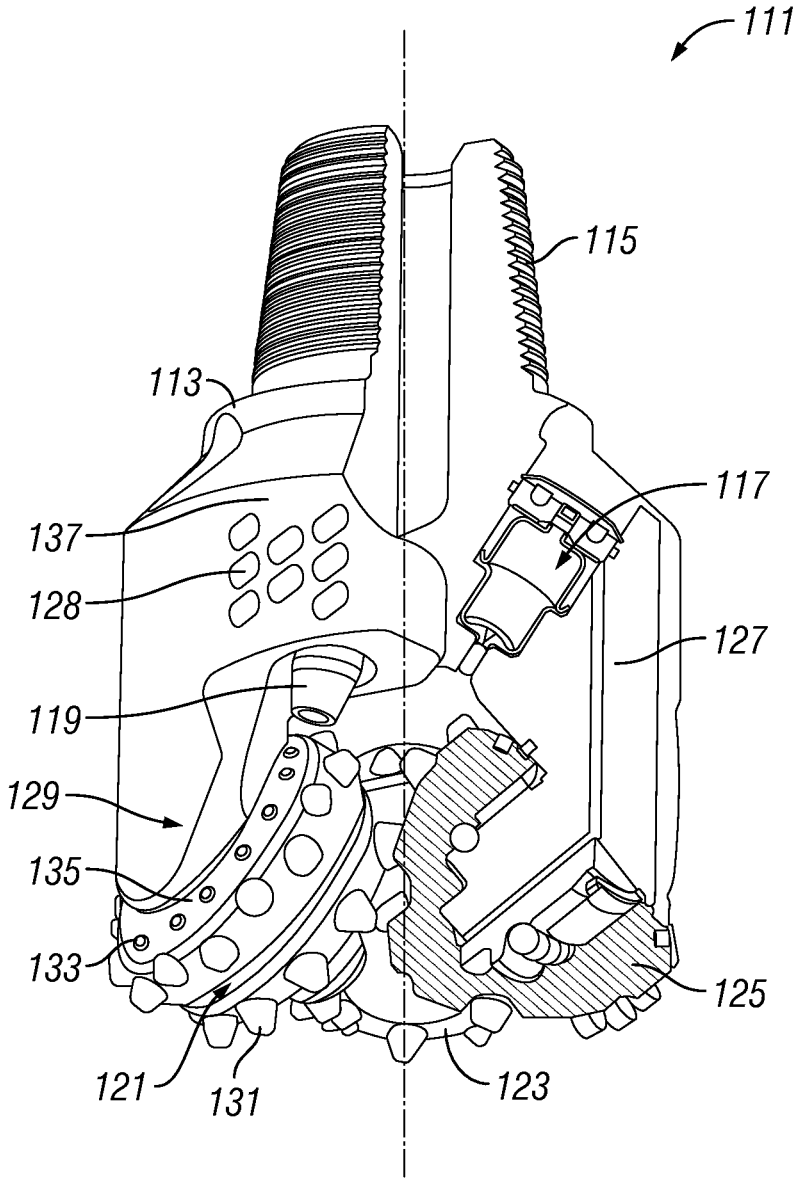
FIG. 5 illustrates a side, partial cut-away view of an exemplary roller cone drill bit in accordance with certain aspects of the present disclosure.

Referring to FIG. 5, an exemplary earth-boring bit 111 of the roller-cone type in accordance with aspects of the present disclosure is generally illustrated, the bit 111 having a bit body 113 with one or more bit legs 127 depending from the bit body. Bit body 113 has a set of threads 115 at its upper end for connecting the bit into a drill string (not shown). As generally shown in the figure, the bit leg may have a generally circumferentially extending outer surface, a leading side, and a trailing side. Bit body 111 has a number of lubricant compensators 117 for reducing the pressure differential between lubricant in the bit and drilling fluid pressure on the exterior of the bit. At least one nozzle 119 is provided in bit body 113 for directing pressurized drilling fluid from within the drill string to return cuttings and cool bit 111. One or more cutters or cones 121 are rotatably secured to bit body 113 on a cantilevered bearing shaft 120 depending inwardly from the bit let. Typically, each bit 111 of the rolling cone type (also termed "tricone" bits) has three cones 121, 123, 125 rotatably mounted to the bit body 113 via bit leg 127, and one of the cones 121 is partially obscured from view in FIG. 5. A shirttail region 129 of the bit is defined along an edge of the bit leg that corresponds with the cone. The bit legs and/or bit body may also optionally include one or more gauge sections 128 having a face which contact the walls of the borehole that has been drilled by the bit 111, and which preferably carry one or more gauge cutters 137 (such as polycrystalline diamond compact cutters) for cutting the sides of the borehole, such as during directional or trajectory-type drilling operations.

Each cone 121 has a generally conical configuration containing a plurality of cutting teeth or inserts 131 arranged in generally circumferential rows, such as the heel row, inner role, gauge row, and the like. In accordance with certain embodiments of the disclosure, teeth 131 can be machined or milled from the support metal of cones 121, 123, 125. Alternately, teeth 131 may be tungsten carbide compacts that are press-fitted into mating holes in the support metal of the cone. Each cone 121, 123, 125 also includes a gage surface 135 at its base that defines the gauge or diameter of bit 111, and which may include a circumferential row of cutter inserts 137 known as gauge row cutters or trimmers, as well as other cutting elements such as gauge compacts having a shear cutting bevel (not shown).

As generally illustrated in FIG. 5, bit body 113 of exemplary roller-cone bit 111 is made up of three head sections welded together. Each head section has a bit leg 127 that extends downward from body 113 and supports one of the cones 121, 123, 125. Bit legs 127 and head sections have outer surfaces that are segments of a circle that define the outer diameter of bit 111. Recessed areas 129 are located between each bit leg 127, the recessed areas being less than the outer diameter of body 113 so as to create channels for the return of drilling fluid and cuttings during bit operation.

Figure 6:
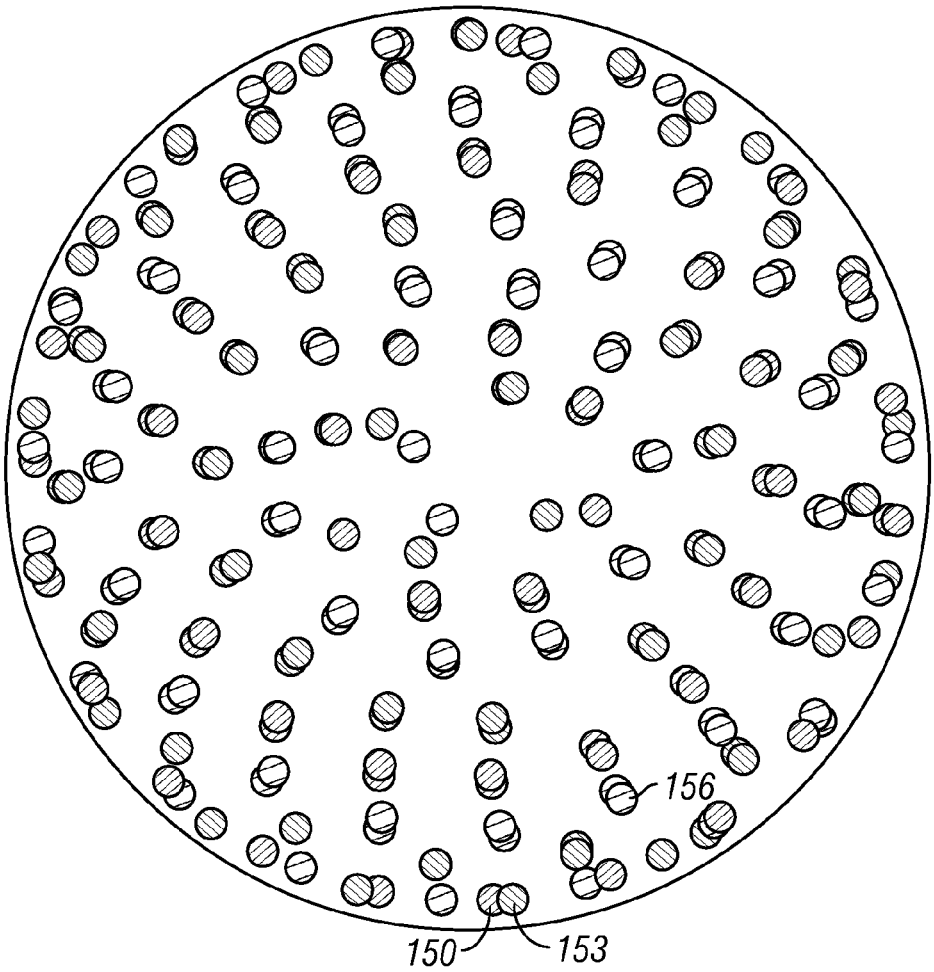
FIGS. 6-7 illustrate exemplary bottom hole patterns for single and multiple revolutions, respectively, of a drill bit having good cutting efficiency.
Figure 7:
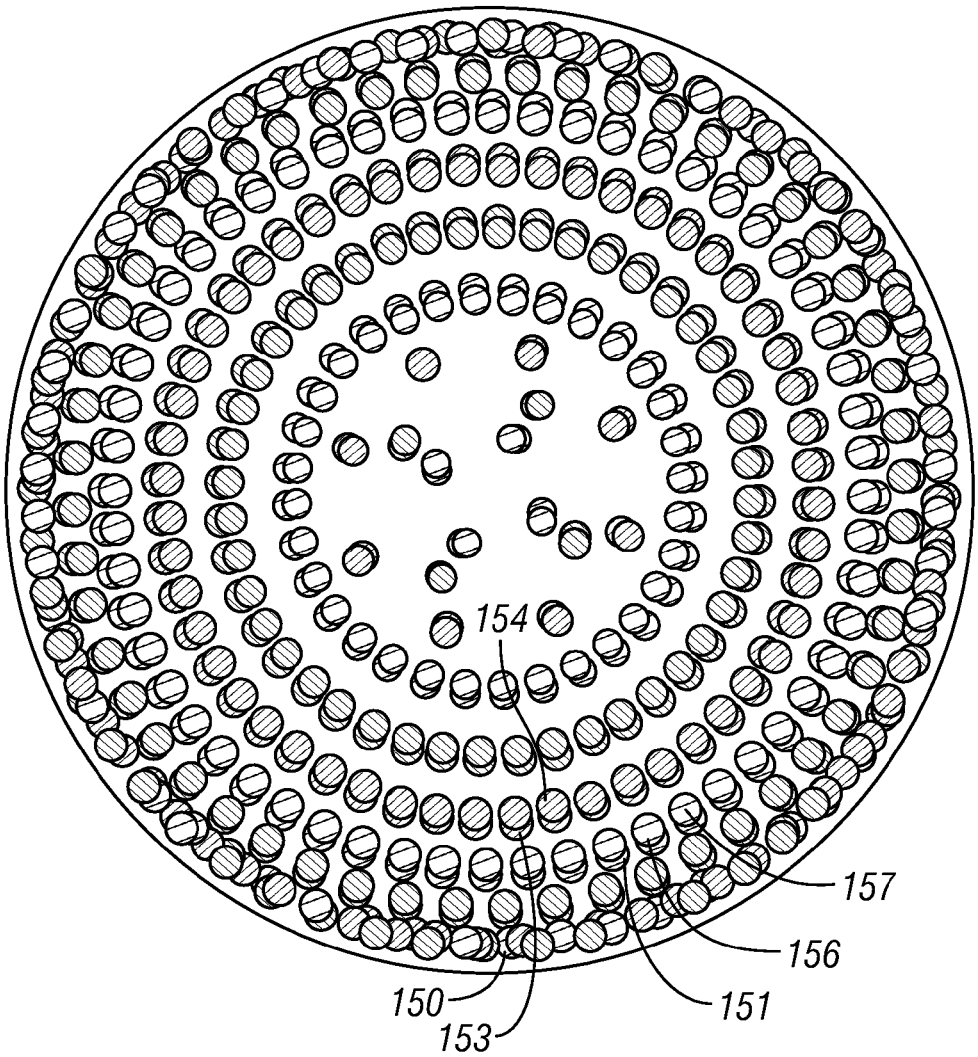

For example, FIG. 6 shows the initial cuts 150, 153, and 156 made by cutting elements on the first, second, and third cones 121, 123, and 125, respectively, after a single revolution of an exemplary drill bit, such as the drill bit 111 of FIG. 5. FIG. 7 generally illustrates the cuts 151, 154, 157 formed by the respective cones after two revolutions of the bit. A bit can be simulated over a broad range of roll ratios and cutter angles, as appropriate, to better define the performance of the bit in a more general sense.

Figure 8:
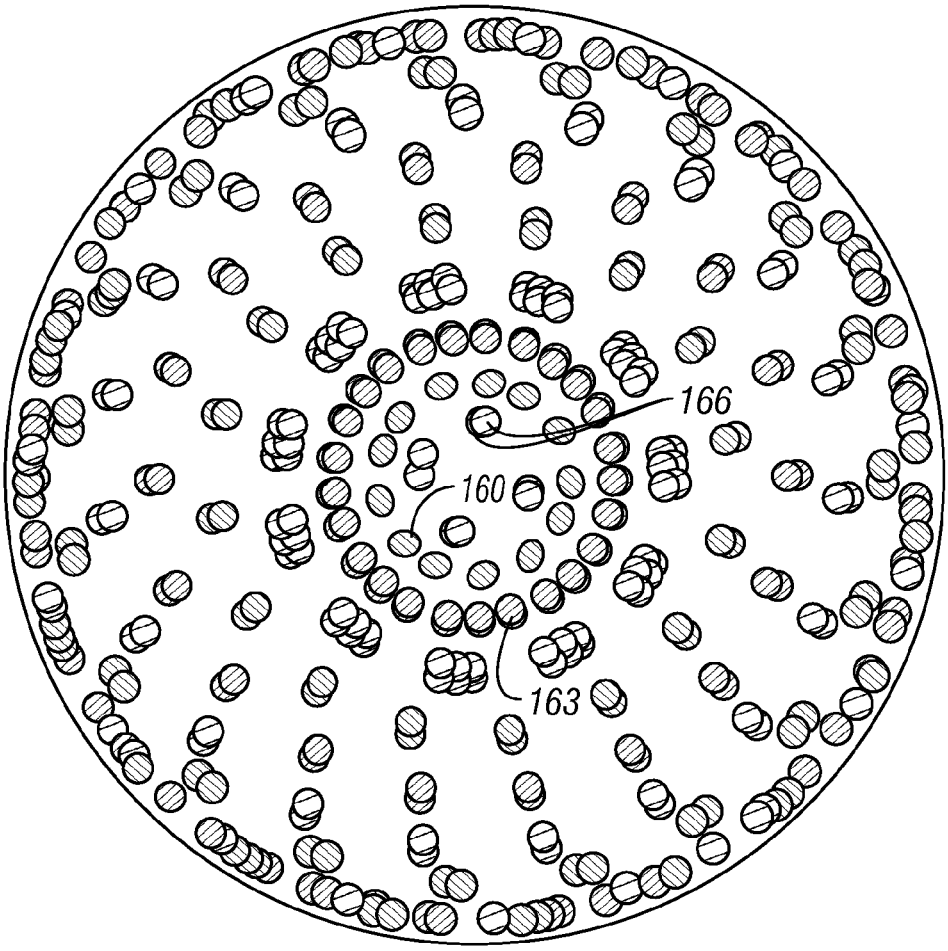
FIG. 8 illustrates an exemplary bottom hole pattern for multiple revolutions of a drill bit having poor cutting efficiency.

An efficiency of a cone can be determined by evaluating the total area on bottom that the cone removed from the bottom hole compared to the maximum and minimum areas that were theoretically possible. The minimum area is defined as the area that is cut during a single bit revolution at a fixed roll ratio. In order for a cone to cut this minimum amount of material, it must track perfectly into the previous cuts on every subsequent revolution. A cone that removed the minimum area is defined to have zero (0%) efficiency. For purposes of illustration only, an exemplary depiction of a drill bit having a very low efficiency is depicted in FIG. 8, which represent three revolutions of the bit. As can be seen in this general view, the areas 160, 163, 166 cut by the three respective cones over three revolutions vary by only a small amount.

The maximum area is defined as the area that is removed if every cutting element removes the theoretical maximum amount of material. This means that on each revolution, each cutting element does not overlap an area that has been cut by any other cutting element. A cone that removes the maximum material is defined to have 100% efficiency. An example of a drill bit having a high degree of efficiency is depicted in FIGS. 6-7, which represent one and three revolutions of the bit, respectively.

Cone efficiency for any given cone is a linear function between these two boundaries. Bits that have cones with high efficiency over a range of roll ratios will drill with less tracking and therefore higher rate of penetration (ROP) of the formation. In one embodiment, the lowest efficiencies for a cone are increased by modifying the spacing arrangement or otherwise moving cutting elements to achieve greater ROP. In another embodiment, the average efficiency of a cone is increased to achieve greater ROP.

Referring to FIGS. 9-10, tracking is where a first kerf 100*a* produced by a first row of cutters 25, on one of the roller cones 21, overlaps with a second kerf 100*b* produced by second row of cutters 27, such as on another of the roller cones 23. More severe tracking is where craters 102*b* formed by the cutters 27 of the second row of cutters 25 actually overlap with craters 102*a* formed by the cutters 25 of the first row of cutters 25. In this case, the second row of cutters 25, and possibly the second roller cone 21, provides a reduced contribution to the overall rate of penetration (ROP) of the bit 11. Additionally, tracking may actually lead to more rapid wear of the roller cones 21 and 23.

Figures 9A, 9B, 9C, 9D:
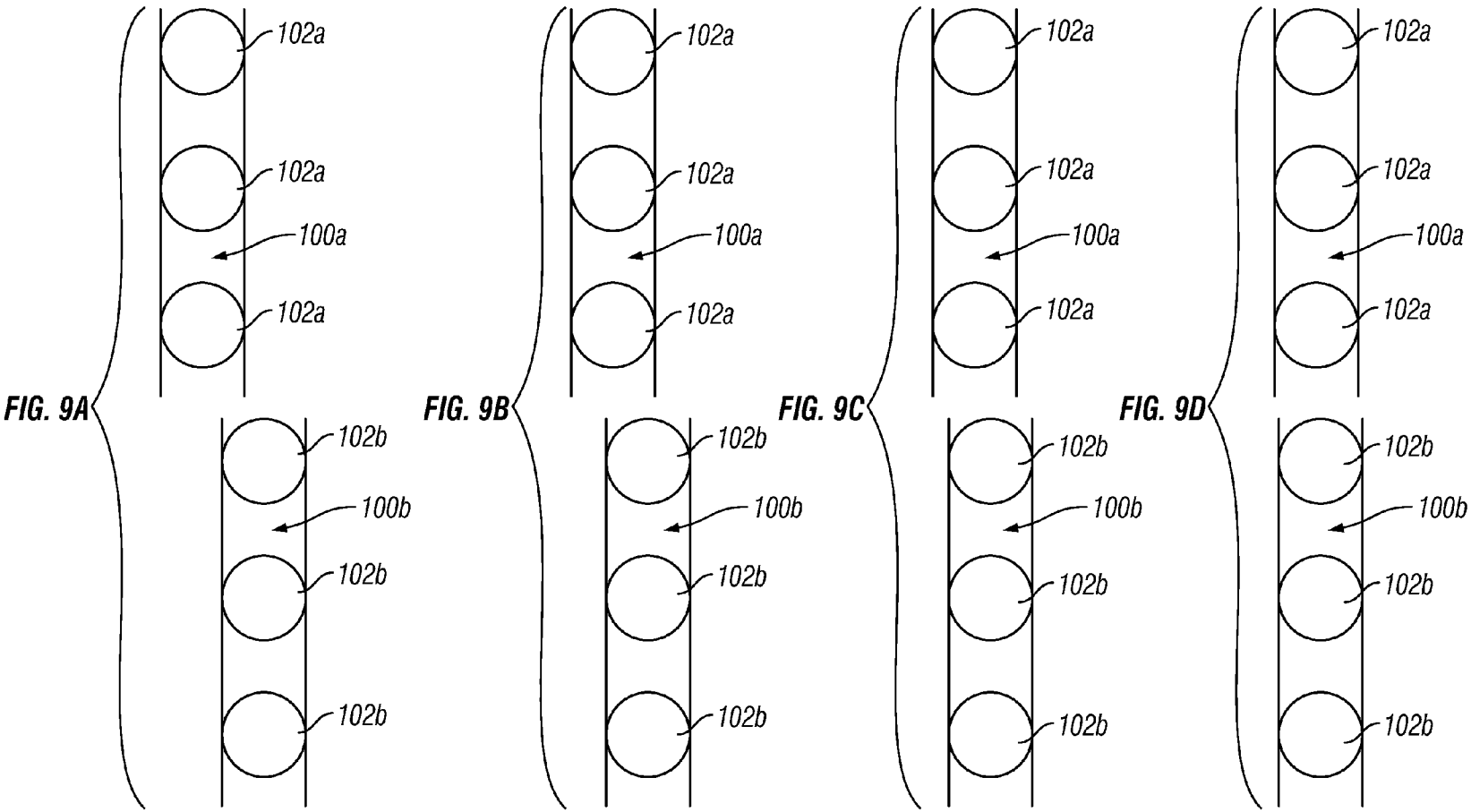
FIG. 9A illustrates an exemplary diagram showing a relationship between sections of overlapping kerfs and craters, with the kerfs shown as straight to more readily understand the present disclosure.
FIG. 9B illustrates an exemplary diagram showing a relationship between sections of significantly overlapping kerfs and craters, with the kerfs shown as straight to more readily understand the present disclosure.
FIG. 9C illustrates a diagram showing a relationship between sections of substantially overlapping kerfs and craters, with the kerfs shown as straight to more readily understand the present disclosure.
FIG. 9D illustrates a diagram showing a relationship between sections of completely overlapping kerfs and craters, with the kerfs shown as straight to more readily understand the present disclosure.
Figures 10A, 10B, 10C, 10D:
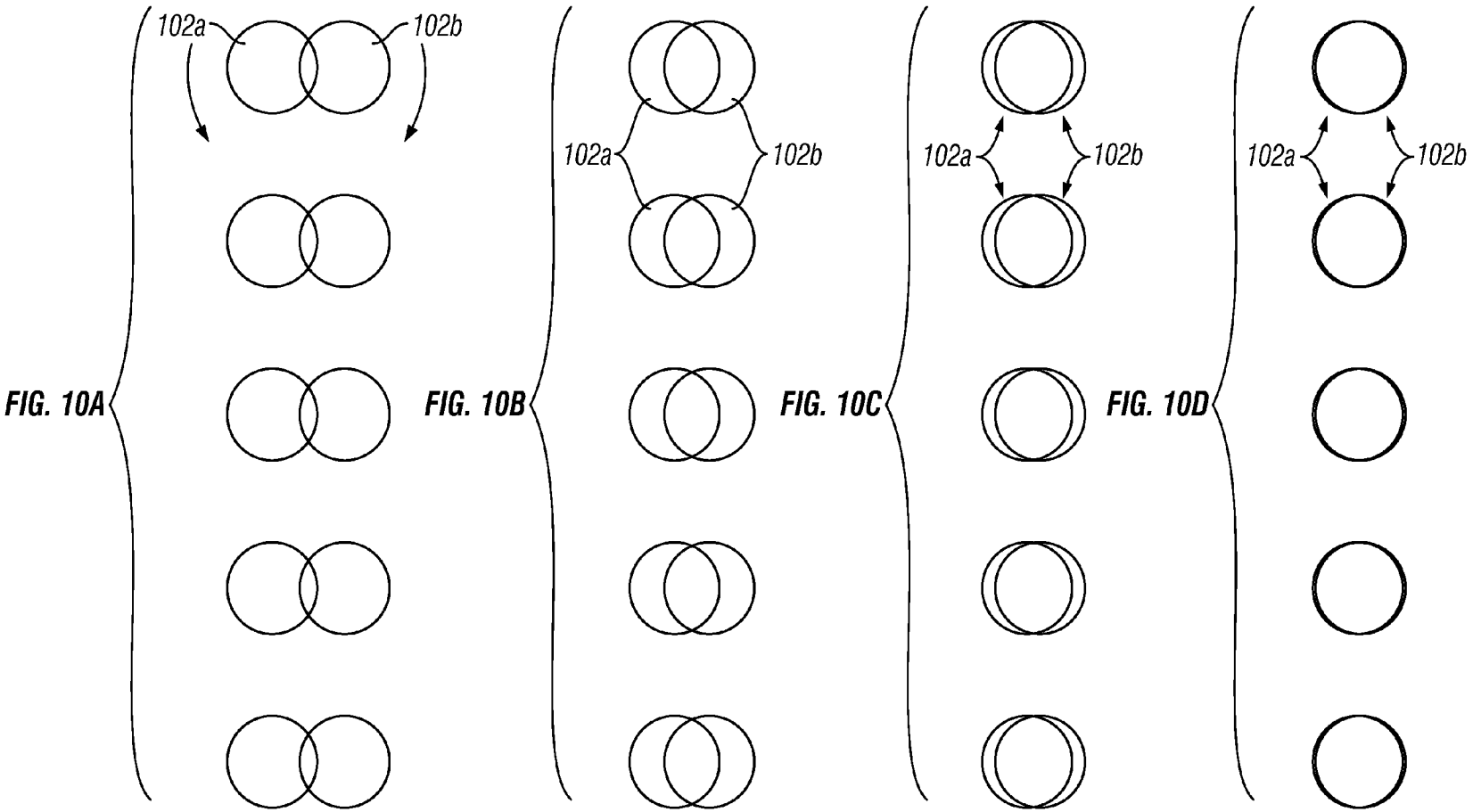
FIG. 10A illustrates a diagram showing a relationship between overlapping craters created by corresponding rows of cutters, shown in a straight line to more readily understand the present disclosure.
FIG. 10B illustrates a diagram showing a relationship between significantly craters formed by corresponding rows of cutters, shown in a straight line to more readily understand the present disclosure.
FIG. 10C illustrates a diagram showing a relationship between substantially craters formed by corresponding rows of cutters, shown in a straight line to more readily understand the present disclosure.
FIG. 10D illustrates a diagram showing a relationship between completely craters formed by corresponding rows of cutters, shown in a straight line to more readily understand the present disclosure.

In FIGS. 9A-9D, the kerfs 100*a*, 100*b* (as illustrated generally in FIG. 6) have been straightened, and only portions of the kerfs 100*a*,100*b* are shown, to more readily show the relationship between two kerfs 100*a*,100*b* and two sets of craters 102*a*,102*b*. As shown in FIG. 9A, the kerfs 100*a*,100*b* may simply have some small degree (e.g., less than about 25%) of overlap. This is referred to as general overlap, or overlapping. In this case, the rows of cutters 25, 27 on the cones 21, 23 that create the kerfs 100*a*,100*b* are similarly offset from the central axis 15 of the bit, and therefore the rows may be referred to as having similar offset, or being similarly offset, from the central axis 15. As shown in FIG. 9B, the kerfs may overlap by about 50% or more. This is referred to as "significant overlap," or significantly overlapping. Because the rows that create the kerfs are offset from the central axis 15 of the bit, this may also be referred to as about equal offset, or about equally offset, from the central axis 15. As shown in FIG. 9C, the exemplary kerfs 102*a*, 102*b* may overlap by about 75% or more. This is referred to as "substantial overlap," or substantially overlapping. Because the rows that create the kerfs are offset from the central axis 15 of the bit, this may also be referred to as a substantial equal offset, or substantially equally offset, from the central axis 15 of the bit 11. As shown in FIG. 9D, the kerfs 102*a*, 102*b* may also overlap by about 95-100%. This is referred to as "substantially complete overlap," or substantially completely overlapping. Because the rows that create the kerfs are offset from the central axis 15 of the bit, this may also be referred to as an "equal offset," or equally offset, from the central axis 15 of the drill bit.

The same may be said of the crater overlap formed by the cutters 25, 27 on the cones 21, 23, i.e. an overlap of about 50% or more is referred to as "significant overlap" with about equal offset, from the central axis; an overlap of about 75% or more is referred to as a "substantial overlap" with substantially equal offset from the central axis 15; and an overlap of about 95-100% overlap is referred to as a "substantially complete overlap" with equal offset from the central axis 15, as shown in FIGS. 10A-10D. While the rows of craters 102*a*, 102*b* are shown with primarily lateral overlap, the overlap may be longitudinal or a combination of lateral and longitudinal overlap, as is better shown in FIGS. 11A-11C.

Figures 11A, 11B, 11C:
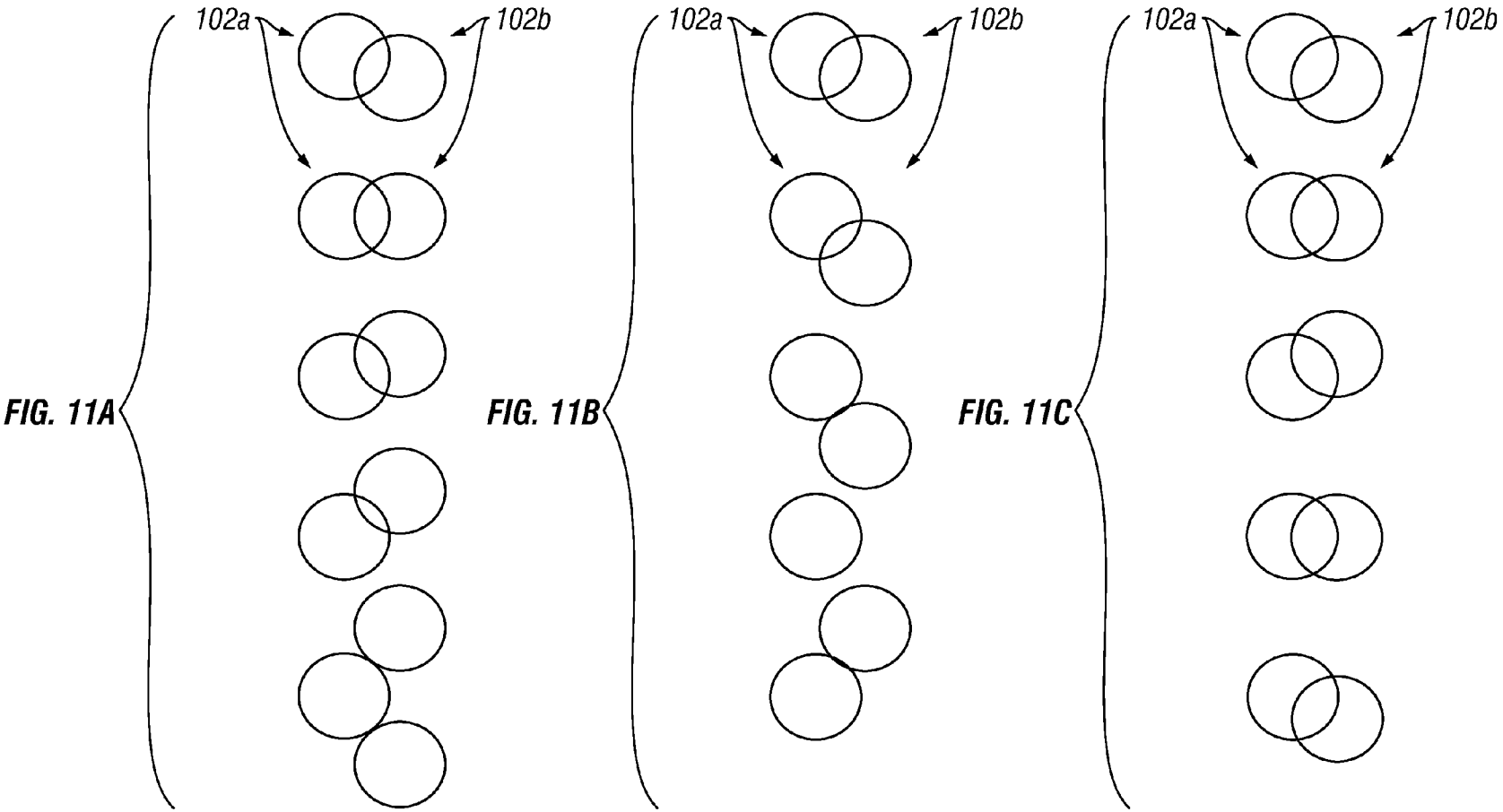
FIG. 11A illustrates a diagram showing two rows of craters formed by rows of cutters, with the rows of cutters having different cutter pitches, shown in a straight line to more readily understand the present disclosure.
FIG. 11B illustrates another diagram showing two rows of craters formed by rows of cutters, with the rows of cutters having different cutter pitches, shown in a straight line to more readily understand the present disclosure.
FIG. 11C illustrates a diagram showing two rows of craters formed by rows of cutters, with one of the rows of cutters having two different cutter pitches, shown in a straight line to more readily understand the present disclosure.

One possible approach to reducing consistent overlap is to vary the pitch, or distance between the cutters 25, on one or both of the roller cones 21. For example, as shown in FIG. 11A, FIG. 11B and FIG. 11C, the first roller cone 21 may have one or more rows of cutters 25 with a different cutter pitch than the second roller cone 23, or an overlapping row of cutters 27 on the second roller cone 23. In FIGS. 11A-11C, the rows of craters 102*a*,102*b* that would be formed by the rows of cutters 25, 27 have been straightened to more readily show the relationship between two kerfs 100*a*,100*b* and two sets, or rows, of craters 102*a*,102*b*. In any case, the first kerf, or row of craters 102*a*, produced by the first row of cutters 25, on the first roller cone 21, may overlap with the second kerf, or row of craters 102*b*, produced by the second row of cutters 27, on the second roller cone 23, but the craters formed by the cutters 25 would not necessarily consistently overlap substantially, or even significantly. Rather, with uniform but different cutter pitches, the overlap would be variable, such that some craters 102*a*,102*b* overlap completely while other craters 102*a*,120*b* have no overlap. Thus, even with complete kerf tracking, i.e. the kerfs completely overlapping, the craters would overlap to some lesser, varying degree. In this case, some craters may completely overlap, while some craters would not overlap at all.

Figure 12A:
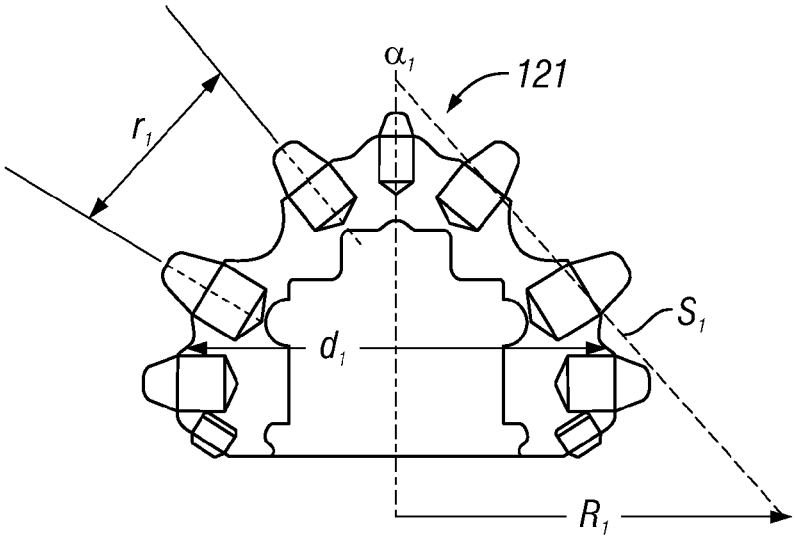
FIGS. 12A-12B illustrate cross-sectional views of exemplary roller cones in accordance with the present disclosure.
Figure 12B:
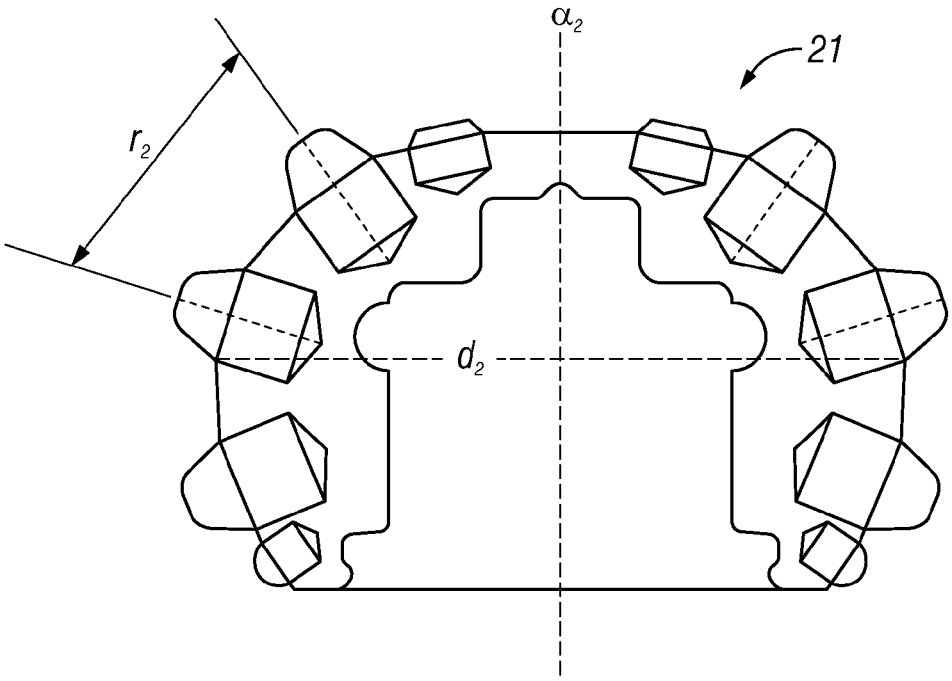

As is evident from the above, varying the pitch between cutters, the pitch angle, and/or the diameter of the cones on the same drill bit can reduce or eliminate unwanted bit tracking during bit operation. Referring to FIG. 12A and FIG. 12B, cross-sectional views of an exemplary conical rolling cone 121, and an exemplary frusto-conical rolling cone 21 are illustrated, showing several dimensional features in accordance with the present disclosure. For example, the diameter $d_1$ of cone 121 is the widest distance across the cone, near the base of the cone, perpendicular to the central axis of the cone, $\alpha_1$. Mathematically, the diameter $d_1$ of roller cone 21 can be determined by measuring the angle ($\beta$) between the vertical axis, $\alpha_1$, and a line drawn along the sloping side, $S_1$. The radius, $R_1$, of cone 121 can then be determined as the tangent of the height of the cone 121, and so the diameter $d_1$ of cone 121 can be expressed mathematically as follows: $d_1 = 2\times \text{height}\times\tan(\beta)$. For the frusto-conical cone 21, such as illustrated with hybrid drill bit 11 in FIG. 1, the diameter of the bit ($d_2$) as used herein refers to the distance between the widest outer edges of the cone itself.

FIG. 12 also illustrates the pitch of the cutters 25 and 125 on the cones 21 and 121, in accordance with the present disclosure. The pitch is defined generally herein to refer to the spacing between cutting elements in a row on a face of a roller cone. For example, the pitch may be defined as the straight line distance between centerlines at the tips of adjacent cutting elements, or, alternatively, may be expressed by an angular measurement between adjacent cutting elements in a generally circular row about the cone axis. This angular measurement is typically taken in a plane perpendicular to the cone axis. When the cutting elements are equally spaced in a row about the conical surface of a cone, the arrangement is referred to as having an "even pitch" (i.e., a pitch angle equal to 360° divided by the number of cutting elements). When the cutting elements are unequally spaced in a row about the conical surface of a cone, the arrangement is referred to as having an "uneven pitch". In accordance with certain aspects of the present disclosure, the term "pitch" can also refer to either the "annular pitch" or the "vertical pitch", as appropriate. The term "annular pitch" refers to the distance from the tip of one cutting element on a row of a rolling cone to the tip of an adjacent cutting element on the same or nearly same row. The term "vertical pitch" refers to the distance from the tip of one cutting element on a row of a rolling cone (such as cone 21 or 121) to the tip of the closest cutting element on the next vertically-spaced row on the cone, such as illustrated by $r_1$ and $r_2$ on FIG. 12. Often the pitch on a rolling cone is equal, but sometimes follows a pattern of greater than and less than a equal pitch number. The term "pitch angle," as used herein, is the angle of attack of the teeth into the formation, which can be varied tooth to tooth to suit the type of formation being drilled.

For example, the first cutter pitch may be 25% larger than the second cutter pitch. In other words, the cutters 25 may be spaced 25% further apart with the first cutter pitch when compared to the second cutter pitch. Alternatively, the first cutter pitch may be 50% larger than the second cutter pitch. In still another alternative, the first cutter pitch may be 75% larger than the second cutter pitch. In other embodiments, the first cutter pitch may be different than the second cutter pitch by some amount between 25% and 50%, between 50% and 75%, or between 25% and 75%.

Figure 13:
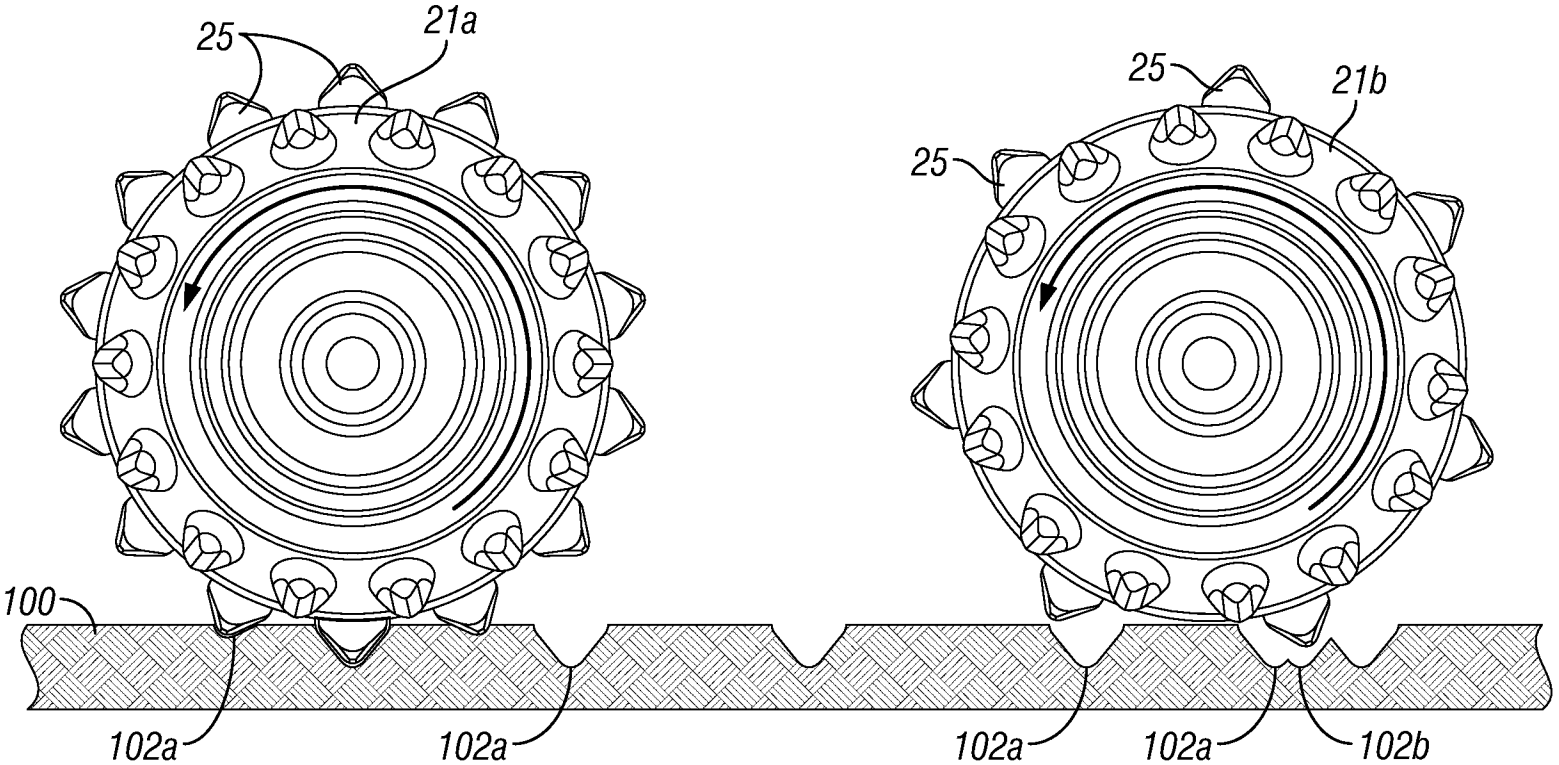
FIG. 13 illustrates a cross-sectional view of two corresponding rows of cutters, having at least similar offsets from a central axis of the bit, each on separate roller cones, with the rows of cutters having different cutter pitches.

Of course, the first cutter pitch may be smaller than the second cutter pitch, by 25%, 50%, 75%, or some amount therebetween, as shown in FIG. 11B and FIG. 13. More specifically, as shown in FIG. 11B and FIG. 13, a first row of cutters 25 on the first roller cone 21*a* may use the first cutter pitch and a second row of cutters 27 on the second roller cone 23*b* may use the second, larger cutter pitch, or spacing between the cutters 27. Thus, even where the first and second rows of cutters 25, 27 contribute to the same kerf 100, the rows of cutters 25, 27 form craters 102*a*,102*b* that do not consistently overlap, or overlap to a lesser, varying degree.

As a further example, a first row of cutters 25 on the first roller cone 21 may use the first cutter pitch and a second row of cutters 25 on the first roller cone 21 may use the second cutter pitch. Here, to further avoid severe tracking, a first row of cutters 25 on the second roller cone 21, corresponding to or otherwise overlapping with the first row of cutters 25 on the first roller cone 21, may use the second cutter pitch. Similarly, a second row of cutters 25 on the second roller cone 21, corresponding to or otherwise overlapping with the second row of cutters 25 on the first roller cone 21, may use the first cutter pitch. Thus, no two corresponding, or overlapping, rows use the same cutter pitch, and each roller cone has at least one row of cutters 25 with the first cutter pitch and another row of cutters 25 with the second cutter pitch.

Figure 14:
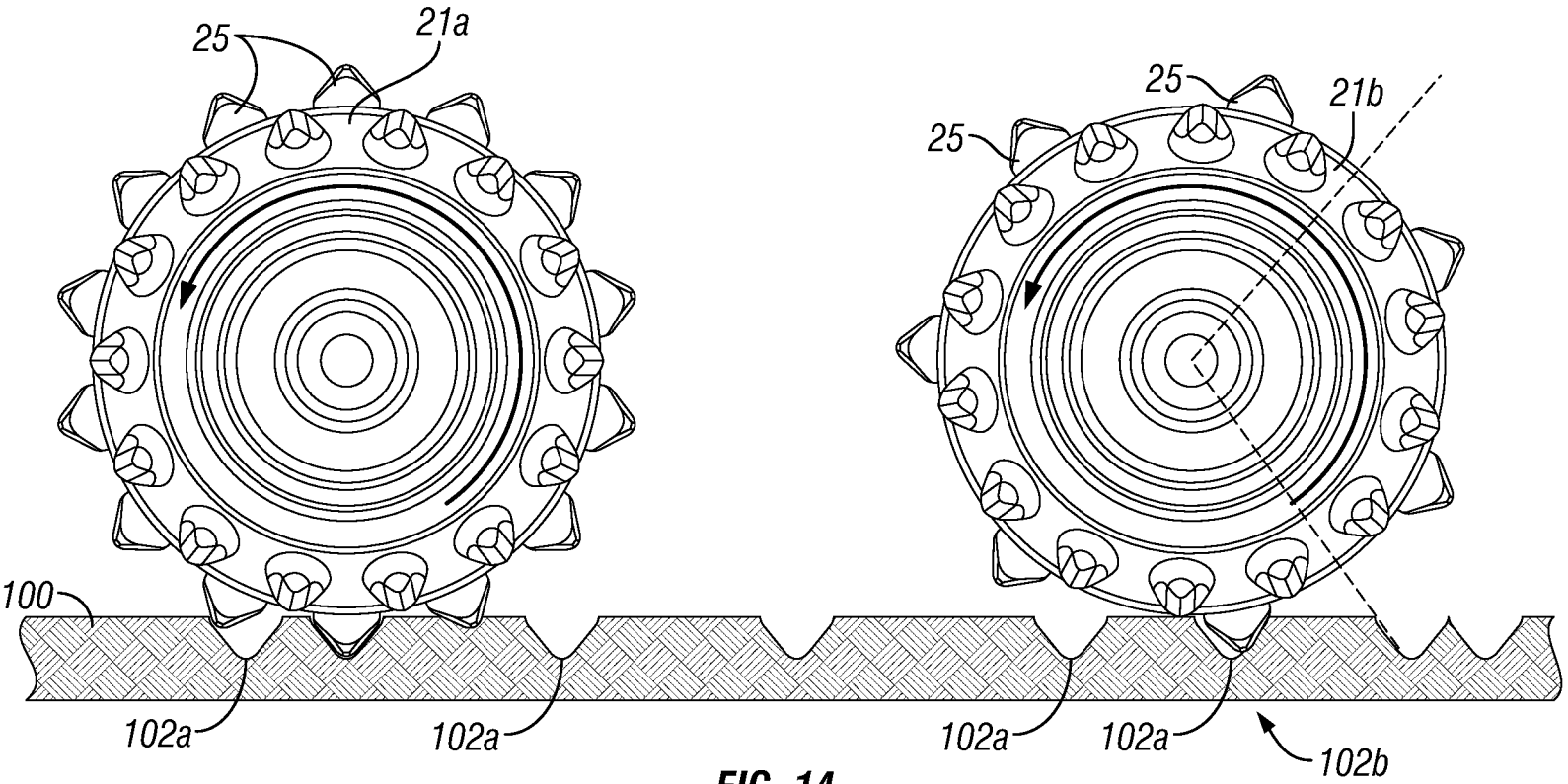
FIG. 14 illustrates a cross-sectional view of two corresponding rows of cutters, having at least similar offsets from a central axis of the bit, each on separate roller cones, with one of the rows of cutters having two different cutter pitches.

Another possible approach would be for one or more rows of cutters 25 on the first roller cone 21 to have a different cutter pitch about its circumference. For example, as shown in FIGS. 11C and 14, a portion of the first or second row of cutters 25, may use the first cutter pitch, while the remaining two thirds of that row of cutters 25 may use the second cutter pitch. In this case, the other, overlapping or corresponding, row of cutters 25 may use the first cutter pitch, second cutter pitch, or a completely different third cutter pitch. Of course, this may be broken down into halves and/or quarters.

In another example, one third of the first row of cutters 25, on the first roller cone 21, may use the first cutter pitch, another one third of the first row of cutters 25 may use the second cutter pitch, and the remaining one third of the first row of cutters 25 may use the third cutter pitch. In this case, the other, overlapping or corresponding, row of cutters 25 may use the first cutter pitch, second cutter pitch, the third cutter pitch, or a completely different fourth cutter pitch.

Because the cutter pitch, or spacing/distance between the cutters 25 can vary in this manner, the first kerf produced by the first row of cutters 25, on the first roller cone 21, may overlap with the second kerf produced by the second row of cutters 25, on the second roller cone 21, but the craters formed by the cutters 25 would not necessarily consistently overlap substantially, or even significantly. It should be apparent that if the first row of cutters 25 has a greater cutter pitch when compared to the second row, and the first and second rows, or roller cones 21, have the same diameter, the first row will have fewer cutters 25. Thus, this feature of the present invention may be expressed in terms of cutter pitch and/or numbers of cutters in a given row, presuming uniform cutter spacing and diameter of the roller cone 21.

Figure 15:
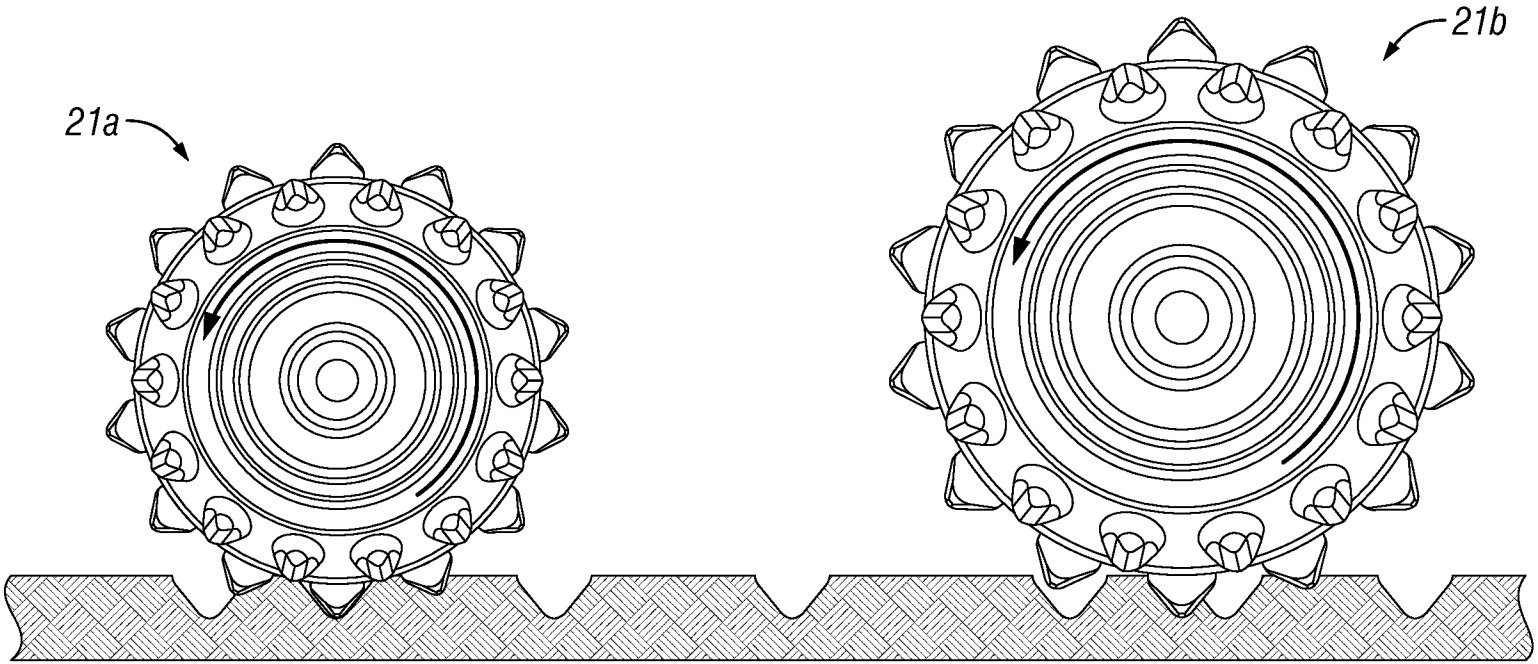
FIG. 15 illustrates a cross-sectional view of two corresponding rows of cutters, having at least similar offsets from a central axis of the bit, each on separate roller cones, with the roller cones having a different diameter and the rows of cutters having different cutter pitches.

One of the problems associated with tracking is if the cutters 25 continually, or consistently fall into craters formed by other cutters 25, the roller cone 21 itself may come into contact with the formation, earth, or rack being drilled. This contact may cause the roller cone 21 to wear prematurely. Therefore, in addition to the different cutter pitches discussed above, or in an alternative thereto, one of the roller cones 21, 23 may be of a different size, or diameter, as shown in FIG. 15. For example, the first roller cone 21 may be 5%, 10%, 25%, or some amount therebetween, larger or smaller than the second roller cone 23. The cutters 25 and/or cutter pitch may also be larger or smaller on the first roller cone 21 when compared with the second roller cone 23.

Figure 16:
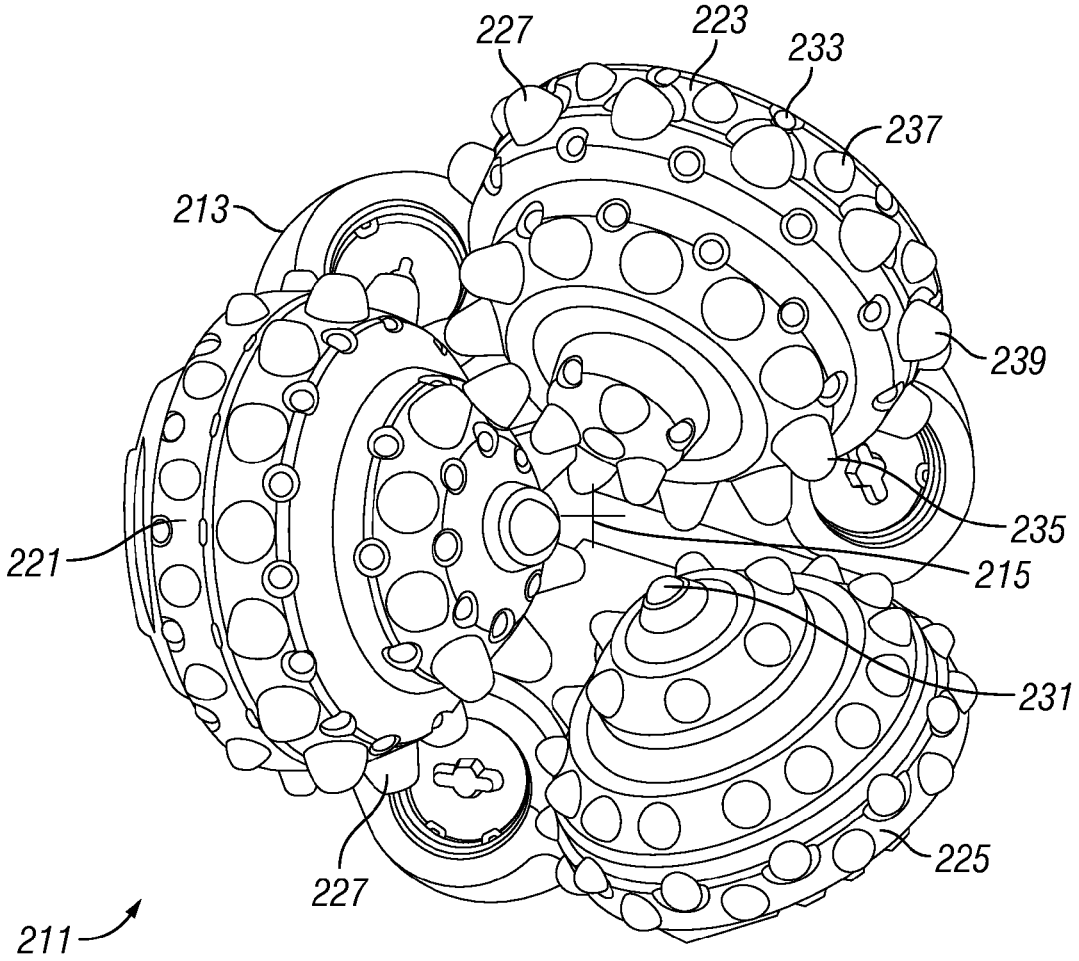
FIG. 16 illustrates a bottom view of an exemplary earth boring drill bit in accordance with embodiments the present disclosure, wherein one of the cones is not intermeshed with the other cones.
Figure 17:
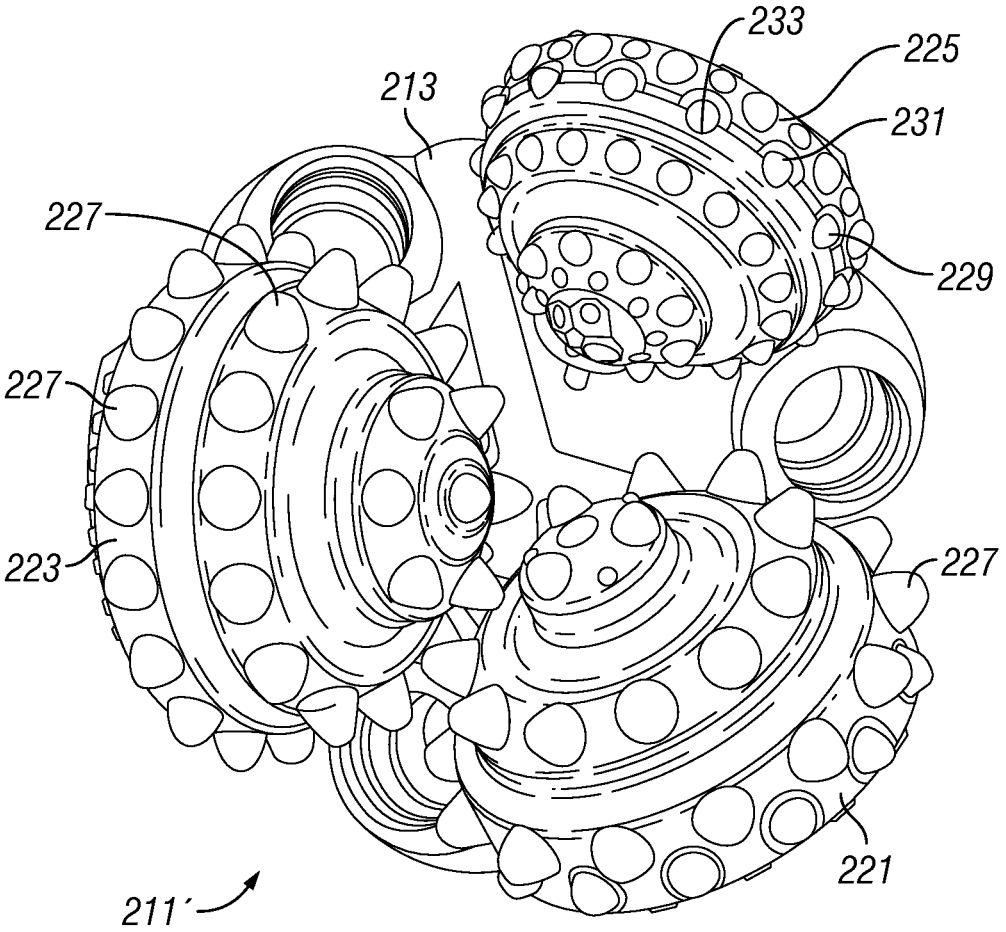
FIG. 17 illustrates a bottom view of an exemplary earth boring drill bit in accordance with embodiments of the present disclosure, wherein one of the cones is of a different diameter and hardness than the other cones.
Figure 18:
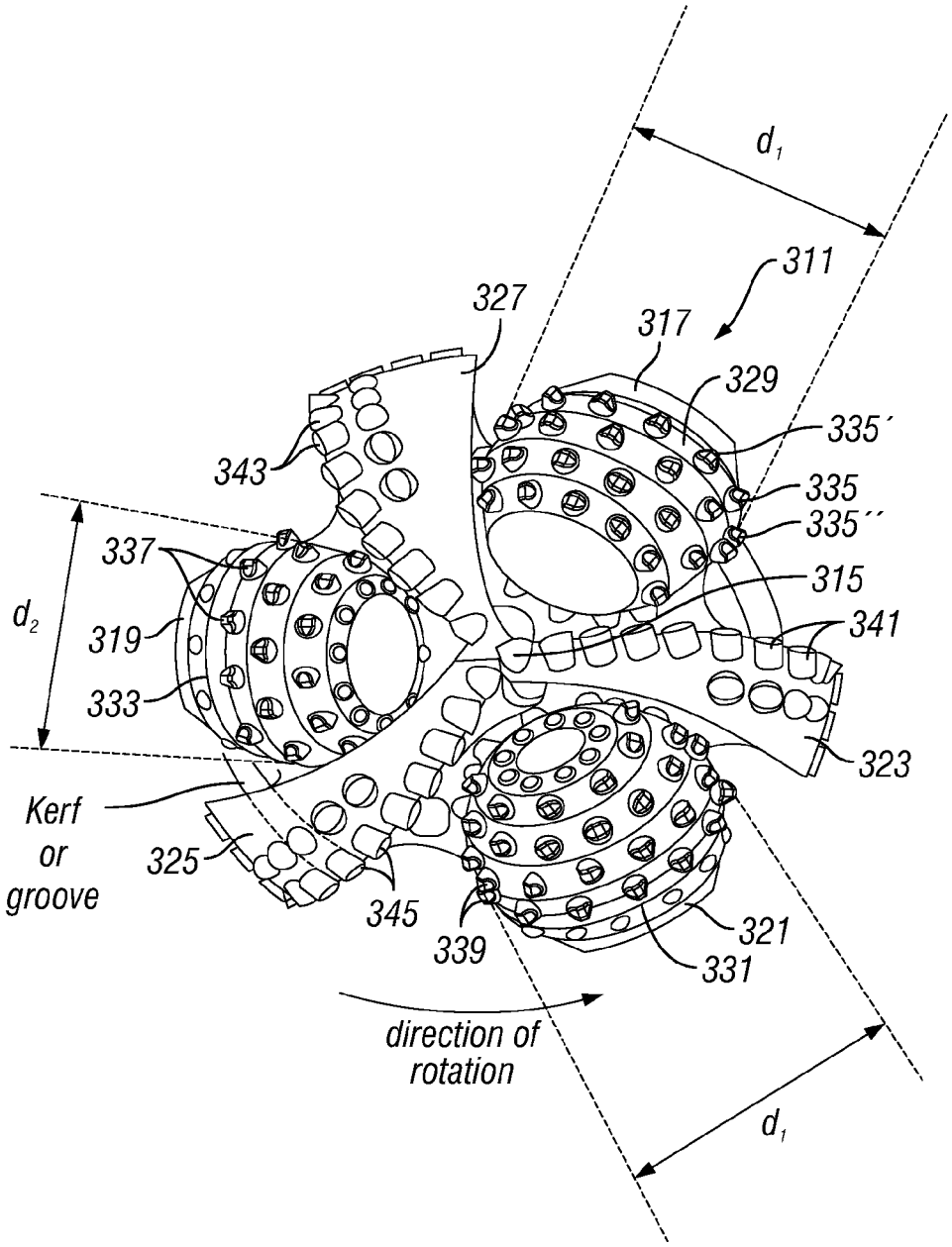
FIG. 18 illustrates a bottom view of an exemplary hybrid-type earth boring drill bit in accordance with embodiments of the present disclosure, wherein one of the cones is of a different diameter and has cutters with varied pitches than the other cones.

Referring to FIGS. 16-18, exemplary cutting arrangements in accordance with the present disclosure are shown wherein such arrangements act to reduce the tendency that a first group of cutting elements on the bits will "track," i.e., fall or slide into impressions made by a second group of cutting elements, and vice versa. FIG. 16 illustrates a top view of an exemplary cone arrangement in accordance with aspects of the present disclosure. FIG. 17 illustrates a top view of an alternative cone arrangement with a cone having a smaller cone diameter. FIG. 18 illustrates a top view of an exemplary cone arrangement in a hybrid earth boring drill bit, wherein one cone has a smaller diameter, and the cutter pitch is varied. These figures will be discussed in conjunction with each other.

FIG. 16 illustrates a top view of a roller cone type drill bit 211, such as the type generally described in FIG. 5, in accordance with aspects of the present disclosure. Bit 211 includes three cones, cones 221, 223, and 225 attached to a bit body 213, and arranged about a central axis 215. Each of the cones has a plurality of rows of cutters 227, extending from the nose 231 to the gauge row 237, with additional rows such as inner rows 235 and heel rows 239 included as appropriate. The cones may also optionally include trimmers 233 proximate to heel row 239 on one or more of the cones. While cutters 227 in FIG. 16 (and FIG. 17) are shown generally as TCI-insert type cutters, it will be appreciated that they may be equivalently milled tooth cutters as appropriate, depending upon the formation being drilled. As shown in the figure, cones 221 and 223 are of a first diameter (e.g., 7-⅞"), while the third cone 225 is of a second, smaller diameter (i.e., 6-⅛"), such that the smaller diameter cone 225 is not intermeshed with the other cones (221, 223). Additionally, different hardness cones may be used within this same bit, such that the cones of a first diameter have a first hardness (e.g., IADC 517), while the cone of the second, smaller diameter has a second hardness that is smaller than or greater than the first hardness (e.g., an IADC hardness of 647). Optionally, and equally acceptable, each of the cones on the bit may have a separate diameter, and a separate hardness, as appropriate.

In FIG. 17, a similar drill bit 211' is illustrated, wherein the bit 211' includes first, second and third rolling cones 221, 223, and 225 attached to a bit body 213 about a central bit axis 215, each of the cones having a plurality of cutting elements, or teeth, 227 attached or formed thereon arranged in circumferential rows as discussed in reference to FIG. 16. As also shown in the figure, the third rolling cone 225 is of a diameter different from (smaller than) the diameter of the first and second cones 221, 223. Further, on at least one row of the third cone 225, which is not intermeshed with the other cones 221, 223 about the central axis 215, cutters vary in their pitch within a row, such as the pitch between cutter 229 and cutter 231 is less than the pitch between cutter 233 and cutter 231.

FIG. 18 illustrates a top view of the working face of an exemplary hybrid drill bit 311 in accordance with embodiments of the present disclosure. The hybrid bit includes two or more rolling cutters (three are shown), and two or more (three are shown) fixed cutter blades. A rolling cutter 329, 331, 333 is mounted for rotation (typically on a journal bearing, but rolling-element or other bearings may be used as well) on each bit leg 317, 319, 321. Each rolling-cutter 329, 331, 333 has a plurality of cutting elements 335, 337, 339 arranged in generally circumferential rows thereon. In between each bit leg 317, 319, 321, at least one fixed blade cutter 323, 325, 327 depends axially downwardly from the bit body. A plurality of cutting elements 341, 343, 345 are arranged in a row on the leading edge of each fixed blade cutter 323, 325, 327. Each cutting element 341, 343, 345 is a circular disc of polycrystalline diamond mounted to a stud of tungsten carbide or other hard metal, which is in turn soldered, brazed or otherwise secured to the leading edge of each fixed blade cutter. Thermally stable polycrystalline diamond (TSP) or other conventional fixed-blade cutting element materials may also be used. Each row of cutting elements 341, 343, 345 on each of the fixed blade cutters 323, 325, 327 extends from the central portion of bit body to the radially outermost or gage portion or surface of bit body. In accordance with aspects of the present disclosure, one of the frusto-conical rolling cutters, cutter 333, has a diameter that is different (in this case, smaller than) the diameters of the other rolling cutters. Similarly, the various circumferential rows of cutting elements on one or more of the rolling cutters have varied pitches between cutter elements, as shown. That is, the pitch between cutting element 335 and 335' is shown to be greater than the pitch between cutting element 335' and 335".

In further accordance with aspects of the present disclosure, the earth boring bit itself, and in particular the roller cones associated with the bit (e.g., bit 11 or 111) and having at least two roller cones with varying pitches, pitch angles and/or cone diameters with respect to each other (e.g. the exemplary bits of FIG. 16, FIG. 17 or FIG. 18), may be configured such that it has different hardness cones within the same bit. For example, referring to the exemplary bit of FIG. 16, cones 221 and 223 may be of a first hardness (e.g., an IADC classification of 517), while the third, smaller diameter cone 225 may have a second hardness (e.g., an IADC classification of 647), such that different hardness cones are used within the same drill bit. Thus, in accordance with further aspects of the present disclosure, two or more cones within the same drill bit may have different hardnesses as measured by the IADC standard. For example, cones may have varying IADC hardness classifications within the range of 54 to 84, or alternatively, have varying IADC series classifications ranging from series 1 to series 8 (as set out in FIG. 19), including series 1, series 2, series 3, series 4, series 5, series 6, series 7, or series 8, inclusive. Those skilled in the art will appreciate that the International Association of Drilling Contractors (IADC) has established a bit classification system for the identification of bits suited for particular drilling applications, as described in detail in "The IADC Roller Bit Classification System," adapted from IADC/SPE Paper 23937, presented Feb. 18-21, 1992. According to this system, each bit falls within a particular 3-digit IADC bit classification. The first digit in the IADC classification designates the formation "series" which indicates the type of cutting elements used on the roller cones of the bit as well as the hardness of the formation the bit is designed to drill. As shown for example in FIG. 19, a "series" in the range 1-3 designates a milled or steel tooth bit for soft (1), medium (2) or hard (3) formations, while a "series" in the range 4-8 designates a tungsten carbide insert (TCI) bit for varying formation hardnesses with 4 being the softest and 8 the hardest. The higher the series number used, the harder the formation the bit was designed to drill. As further shown in FIG. 19, a "series" designation of 4 designates TCI bits designed to drill softer earth formations with low compressive strength. Those skilled in the art will appreciate that such bits typically maximize the use of both conical and/or chisel inserts of large diameters and high projection combined with maximum cone offsets to achieve higher penetration rates and deep intermesh of cutting element rows to prevent bit balling in sticky formations. On the other hand, as also shown in FIG. 19, a "series" designation of 8 designates TCI bits designed to drill extremely hard and abrasive formations. Those skilled in the art will appreciate that such bits typically including more wear-resistant inserts in the outer rows of the bit to prevent loss of bit gauge and maximum numbers of hemispherical-shaped inserts in the bottomhole cutting rows to provide cutter durability and increased bit life.

The second digit in the IADC bit classification designates the formation "type" within a given series which represents a further breakdown of the formation type to be drilled by the designated bit. As further shown in FIG. 19, for each of series 4 to 8, the formation "types" are designated as 1 through 4. In this case, "1" represents the softest formation type for the series and type "4" represents the hardest formation type for the series. For example, a drill bit having the first two digits of the IADC classification as "63" would be used to drill harder formation than a drill bit with an IADC classification of "62". Additionally, as used herein, an IADC classification range indicated as "54-84" (or "54 to 84") should be understood to mean bits having an IADC classification within series 5 (type 4), series 6 (types 1 through 4), series 7 (types 1 through 4) or series 8 (types 1 through 4) or within any later-adopted IADC classification that describes TCI bits that are intended for use in medium-hard formations of low compressive strength to extremely bard and abrasive formations. The third digit of the IADC classification code relates to specific bearing design and gage protection and is, thus, omitted herein as generally extraneous with regard to the use of the bits and bit components of the instant disclosure. A fourth digit letter code may also be optionally included in IADC classifications, to indicate additional features, such as center jet (C), Conical Insert (Y), extra gage protection (G), deviation control (D), and standard steel tooth (S), among other features. However, for purposes of clarity, these indicia are also omitted herein as generally extraneous to the core concepts of the instant disclosure.

Other and further embodiments utilizing one or more aspects of the inventions described above can be devised without departing from the spirit of Applicant's invention. For example, any of the rows of cutters 25, 27 of bit 11 may actually utilize a varying cutter pitch and/or a random cutter pitch and/or pitch angle to reduce tracking. Additionally, the different diameter and/or different cutter pitches may be used with drill bits having three or more roller cones. Further, the various methods and embodiments of the present invention can be included in combination with each other to produce variations of the disclosed methods and embodiments. Discussion of singular elements can include plural elements and vice-versa.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to fully protect all such modifications and improvements that come within the scope or range of equivalent of the following claims.

What is claimed is:

1. A hybrid drill bit defining gage, shoulder, nose and cone regions comprising:

a bit body having a longitudinal central axis;

at least one blade extending from the bit body;

first and second arms extending from the bit body;

a first roller cone rotatably secured to the first arm and extending inwardly toward the central axis, the first roller cone having a plurality of cutting elements in the shoulder or nose regions;

a second roller cone rotatably secured to the second arm and extending inwardly toward the central axis, the second roller cone having a plurality of cutting elements in the shoulder or nose regions; and wherein the first roller cone has a maximum outside diameter in the shoulder or nose regions that is larger than a maximum outside diameter of the second roller cone in the shoulder or nose regions.

2. The drill bit of claim 1, wherein the first roller cone has a different cutter pitch than the second roller cone.

3. The drill bit of claim 1, wherein a cutter pitch of the first roller cone is 25% larger than a cutter pitch of the second roller cone.

4. The drill bit of claim 1, wherein the first roller cone includes two different cutter pitches.

5. The drill bit of claim 1, wherein a row of cutters on the first roller cone is spaced at two different cutter pitches.

6. The drill bit of claim 1, wherein a first portion of a row of cutters on the first roller cone is spaced at a first cutter pitch and a second portion of the row of cutters on the first roller cone is spaced at a second, different cutter pitch.

7. The drill bit of claim 1, wherein a row of cutters on the first roller cone is spaced at a first cutter pitch along one third of its circumference and a second, different cutter pitch along two thirds of its circumference.

8. The drill bit of claim 1, wherein the first roller cone includes two different cutter pitches in a single row of cutters.

9. The drill bit of claim 1, wherein the first and second roller cones each have a row of cutters substantially equally offset from the central axis.

10. The drill bit of claim 9, wherein the substantially equally offset rows have different cutter pitches.

11. The drill bit of claim 9, wherein the substantially equally offset rows have different diameters.

12. The drill bit of claim 1, wherein the first and second roller cones each have a row of cutters similarly offset from the central axis such that their kerfs overlap.

13. The drill bit of claim 12, wherein the overlapping rows have different cutter pitches.

14. The drill bit of claim 12, wherein the overlapping rows have different diameters.

15. A hybrid drill bit comprising:

gage, shoulder, nose and cone regions;

a bit body having a longitudinal central axis;

at least one blade extending from the bit body;

a first and second arm extending from the bit body;

a first roller cone rotatably secured to the first arm and extending inwardly toward the central axis and having a plurality of cutting elements arranged in generally circumferential rows in at least the shoulder and nose regions; and a second roller cone rotatably secured to the second arm and extending inwardly toward the central axis and having a plurality of cutting elements arranged in generally circumferential rows in at least the shoulder and nose regions;

wherein the first roller cone has a different cutter pitch than the second roller cone.

16. The drill bit of claim 15, wherein a cutter pitch of the first roller cone is 25% larger than a cutter pitch of the second roller cone.

17. The drill bit of claim 15, wherein the first roller cone includes two different cutter pitches.

18. The drill bit of claim 15, wherein a row of cutters on the first roller cone is spaced at two different cutter pitches.

19. The drill bit of claim 15, wherein a first portion of a row of cutters on the first roller cone is spaced at a first cutter pitch and a second portion of the row of cutters on the first roller cone is spaced at a second, different cutter pitch.

20. The drill bit of claim 15, wherein a row of cutters on the first roller cone is spaced at a a first cutter pitch along one third of its circumference and a second, different cutter pitch along two thirds of its circumference.

21. The drill bit of claim 15, wherein the first roller cone includes two different cutter pitches in a single row of cutters.

22. The drill bit of claim 15, wherein the first and second roller cones each have a row of cutters substantially equally offset from the central axis.

23. The drill bit of claim 22, wherein the substantially equally offset rows have different cutter pitches.

24. The drill bit of claim 22, wherein the substantially equally offset rows have different diameters.

25. The drill bit of claim 15, wherein the first and second roller cones each have a row of cutters similarly offset from the central axis such that their kerf rows overlap.

26. The drill bit of claim 25, wherein the overlap rows have different cutter pitches.

27. The drill bit of claim 25, wherein the overlap rows have different diameters.

28. The drill bit of claim 15, wherein the first roller cone and the second roller cone have different cone diameters.

29. The drill bit of claim 15, wherein the cutting elements on the first roller cone have a greater IADC hardness than the cutting elements on the second roller cone.

30. An earth-boring hybrid bit comprising:

a bit body defining a central longitudinal axis;

at least one blade extending from the body and configured to support at least one cutting element thereon;

at least two bit legs depending from the bit body and having a circumferentially extending outer surface, a leading side and a trailing side;

a first cone and a second cone rotatably mounted on a cantilevered bearing shaft depending inwardly from the bit legs toward the central axis and each cone having a maximum outside diameter in a shoulder or nose region; and, a plurality of cutters arranged circumferentially about an outer surface of the cones in the shoulder and/or nose regions, wherein the first cone and the second cone have different maximum outside cone diameters.

31. The earth-boring drill bit of claim 30, wherein at least two cutters on at least one of the first and second cones have different pitches.

32. The earth-boring drill bit of claim 30, wherein at least two cutters on at least one of the first and second cones have different pitch angles.

33. The earth-boring drill bit of claim 30, wherein cutters on the first cone have a different IADC hardness then the cutters on the second cone.

34. The earth-boring drill bit of claim 30, further comprising a fixed blade cutter with a leading edge and a trailing edge, and having a plurality of cutting elements arranged in a row on the leading edge of the fixed blade cutter.

* * * * *